US007395859B1

(12) United States Patent
Hill

(10) Patent No.: US 7,395,859 B1
(45) Date of Patent: Jul. 8, 2008

(54) METHOD FOR GROWTH OF A HYDRAULIC FRACTURE ALONG A WELL BORE ANNULUS AND CREATING A PERMEABLE WELL BORE ANNULUS

(76) Inventor: Gilman A. Hill, 7128 S. Poplar La., Englewood, CO (US) 80112

( * ) Notice: Subject to any disclaimer, the term of this patent is extended or adjusted under 35 U.S.C. 154(b) by 0 days.

(21) Appl. No.: 11/481,623

(22) Filed: Jul. 5, 2006

Related U.S. Application Data

(60) Division of application No. 10/751,814, filed on Jan. 5, 2004, now Pat. No. 7,096,943, which is a continuation-in-part of application No. 10/614,272, filed on Jul. 7, 2003, now Pat. No. 6,929,066.

(51) Int. Cl.
*E21B 43/00* (2006.01)

(52) U.S. Cl. ..... 166/278; 166/51; 166/308.1

(58) Field of Classification Search ..... 166/278, 166/51, 308.1
See application file for complete search history.

(56) References Cited

U.S. PATENT DOCUMENTS

| | | | | |
|---|---|---|---|---|
| 6,557,635 | B2 * | 5/2003 | Nguyen et al. | 166/278 |
| 6,766,862 | B2 * | 7/2004 | Chatterji et al. | 166/381 |
| 2002/0134551 | A1 * | 9/2002 | Pringle et al. | 166/305.1 |

* cited by examiner

*Primary Examiner*—William P Neuder
(74) *Attorney, Agent, or Firm*—Edwin H. Crabtree; Ramon L. Pizawo

(57) ABSTRACT

A method for growth of a hydraulic fracture or a tall frac is described wherein the tall frac is disposed next to a well bore using a sandpacked annulus. Also, a method for creating a permeable well bore annulus is disclosed. The method for creating the tall frac includes creating a linear-sourced, cylindrical stress field by maneuvering the intersection of two independent friction-controlled pressure gradients of a frac pad fluid. The intersection of these two frac pad fluid pressure gradients can be controlled when the frac pad fluid traverses along a well bore sandpacked annulus. The first pressure gradient is created by controlling the fluid flow rate and the consequent, friction pressure loss in the frac pad fluid flow through a portion of the sandpacked annulus, located above the top of the upwardly propagating tall frac hydraulic fracture. The first pressure gradient must be significantly greater than the average gradient of the formation, frac-extension pressure gradient. The second pressure gradient is created by the friction loss of the volume flow rate of the frac pad fluid flowing through the combined parallel paths of the sandpacked annulus and the open hydraulic fracture which is propagating outward in the adjacent rock formation below the top of the upwardly propagating tall frac. The second pressure gradient, below the top of the upward-propagating tall frac, should be about equal to or less than the average gradient of the formation, frac-extension pressure gradient at this location.

17 Claims, 16 Drawing Sheets

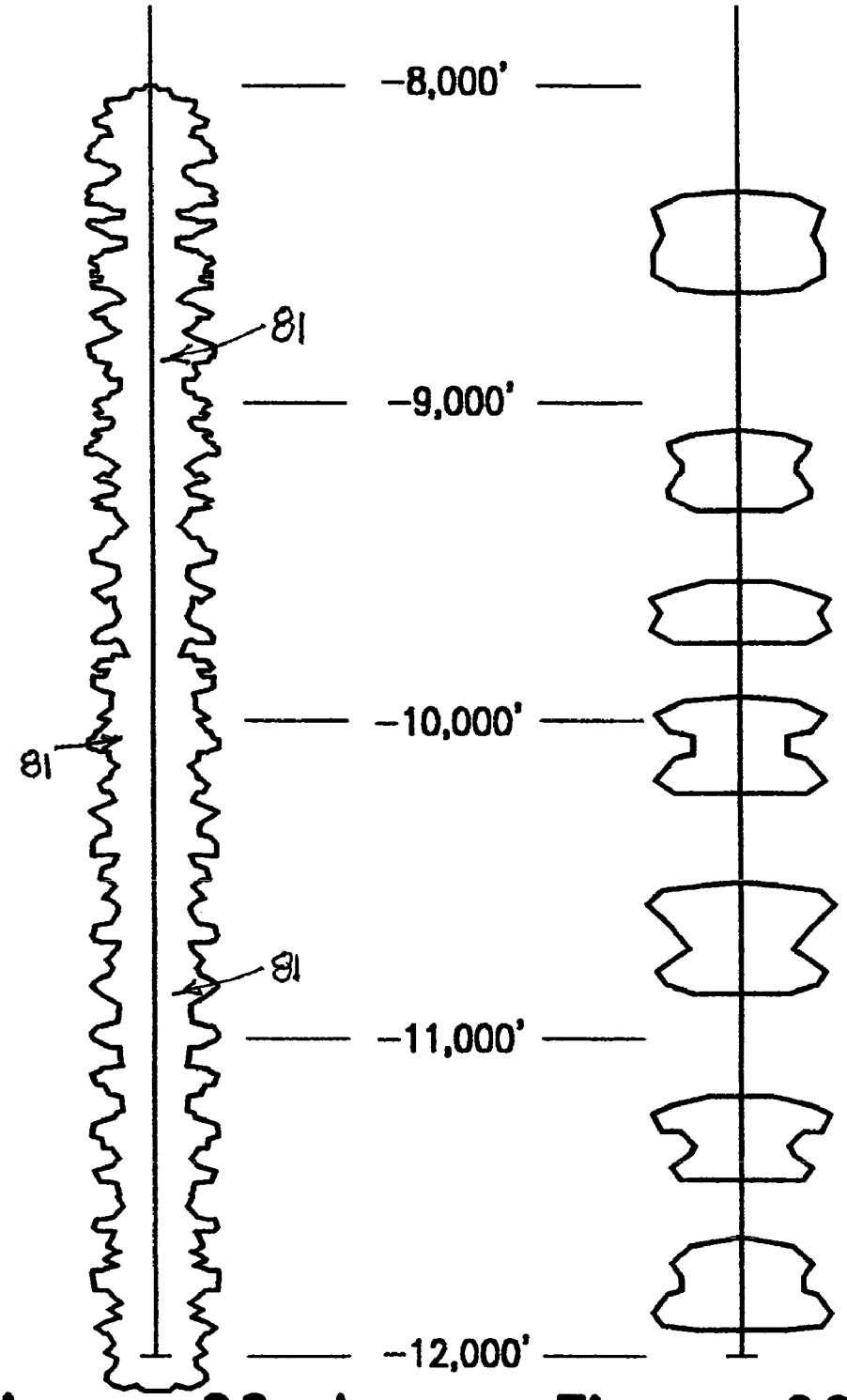
Figure 20-A
Tall-Frac Area
Figure 20-B
Multi-Zone Frac Area

METHOD FOR GROWTH OF A HYDRAULIC FRACTURE ALONG A WELL BORE ANNULUS AND CREATING A PERMEABLE WELL BORE ANNULUS

This application is a divisional application based on a continuation-in-part Ser. No. 10/751,814 filed on Jan. 5, 2004 now U.S. Pat. No. 7,096,943. The continuation-in-part application is based on a patent application filed on Jul. 7, 2003, Ser. No. 10/614,272 and now U.S. Pat. No. 6,929,066, by the subject inventor, and having a title of "METHOD FOR UPWARD GROWTH OF A HYDRAULIC FRACTURE ALONG A WELL BORE SANDPACKED ANNULUS"

BACKGROUND OF THE INVENTION (a) Field of the Invention

This invention relates to a method of hydraulic fracturing of an oil and/or gas well bore and more particularly, but not by way of limitation, to a method of creating an effective hydraulic fracture over a selected interval along a length of a well bore. The fracture along the interval encompasses a multitude of oil and/or gas-saturated sand formations and intervening silt and shale formations. The new method of hydraulic fracturing is used for the purpose of more efficiently producing oil and/or gas from all of these formations.

The subject hydraulic fracturing method uses an uncemented, well bore sandpacked annulus to produce a controllable and movable line source of a frac pad fluid injection in a hydraulic fracture, which results in a cylindrical stress field. The stress field is used for propagating the hydraulic fracture. The propagated hydraulic fracture is called herein a "tall frac". The tall frac is created along a length of the well bore sandpacked annulus.

(b) Discussion of Prior Art

Heretofore in the oil and gas industry, hydraulic fracturing of a well bore involved injecting frac pad fluids through selected perforations in a well casing surrounded by a cement-filled annulus. The objective was to provide adequate isolation of each targeted oil and gas reservoir zone, by carefully cementing the annulus space so that the injected frac pad fluid would create a fracture only in the perforated reservoir zone and would not grow either upward or downward across shale barriers into adjacent zones. Using a limited entry technique, two, three, or more zones within a relatively short interval are perforated and simultaneously frac treated. In some cases, the fracture propagating outward from each perforated zone may interconnect with each other across lithologic barriers, or alternatively, each perforated zone may propagate a separate, isolated, hydraulic fracture without communication through the intervening barriers.

Also, multistage frac programs have been developed to achieve hydraulic fractures in a multiplicity of separated sand packages spaced over extended intervals along the length of the well bore. However, each stage of this type of multistage frac program has to be separately isolated, perforated, and frac-pumped, thereby requiring extended periods of time with large, repetitive, frac-treatment costs.

The above described hydraulic fractures are created essentially by point source fluid injection, resulting in spherical stress fields created around each of the point sources. The resulting hydraulic fracture, created by the spherical stress field, is propagated from each such point source in a plane perpendicular to the direction of the least principal stress in the formation rock with no dimensional restraints.

SUMMARY OF THE INVENTION

In contrast to the above described prior hydraulic-frac art, the subject invention uses a long line source of fluid injection from a permeable, sandpacked annulus in the well bore. This type of fluid injection provides a long cylindrical stress field, which creates the tall frac along the length of the fluid injection line source. The plane of the hydraulic fracture must include the axis of the injection line source, and this frac plane also must be perpendicular to the least principal stress in the cylindrical stress field as observed in a two-dimensional plane perpendicular to the well bore fluid injection line source.

The hydraulic fracture or tall frac is created by using a near continuous, permeable sandpacked annulus, which fills the annulus between an uncemented casing and a well bore wall. The sandpacked annulus is used to provide a hydrodynamically controlled hydraulic pressure in the annulus to create a long, cylindrical stress field. The stress field axis is the same as the axis of the sandpacked annulus in the well bore. The hydraulic fracture or tall frac grows along the well bore axis for the total length of the sandpacked annulus by hydrodynamically controlling the frac pad fluid flow and the consequent pressure gradient in the annulus. The pressure gradient in the annulus, in combination with the pressure gradient in the previously opened hydraulic fracture, can progressively move a frac zone forward or upward. The frac zone is where the hydraulic pressure of the frac pad fluid in the sandpacked annulus exceeds the formation frac-extension pressure. By this process, the hydraulic fracture can grow progressively along the full length of the sandpacked annulus in vertical drilled wells, in directionally drilled deviated wells, and in directionally drilled horizontal wells.

The subject invention provides a means for creating the near-continuous, sandpacked annulus required for the tall frac method by the use of a fluidized sand column filling an annulus between an uncemented casing and a well bore wall with sufficient sand over an extended length ranging from a few hundred feet up to several thousand feet.

In view of the foregoing, it is a primary objective of the subject invention to propagate a hydraulic fracture or a tall frac along a sandpacked annulus thereby penetrating a thick, oil-and-gas-saturated sequence of sands and shales, or other sediments, which need to be fractured and stimulated for economic, oil and gas production.

Another object of the invention is for the tall frac to extend along the length of the well bore, sandpacked annulus for several hundred feet to a few thousand feet depending on the size and number of targeted oil and gas reservoir zones.

Still another object of the invention is to use the subject method of creating the tall frac in conjunction with, but not limited to, first creating a continuous sandpacked annulus along the well bore with the length of the sandpacked annulus ranging from a few hundred feet up to several thousand feet.

Yet another object of the tall frac method is that the invention provides for breaking through lithologic, fracture barriers, which were not heretofore penetrated by hydraulic fractures when using conventional perforated cemented casing with point sourced, spherically stressed frac technologies.

A further objective of this invention is to provide a fluidized bed, sand column within the tall frac as a means to prop open the tall frac over an extended length and ranging from a few hundred feet to several thousand feet.

Another objective of this invention is to create a continuous tall frac along the length of the well bore sandpacked annulus of a directionally drilled well bore, deviated from vertical at a substantial angle of 20° to 60° and greater.

Yet another object of the invention is to create a continuous tall frac along the length of the well bore sandpacked annulus of a directionally drilled horizontal well bore.

Still another objective of the invention is to use the fluidized bed process to build a near-continuous sandpacked annulus in an uncemented cased well bore for any purpose such as for control of production of sand, or other reservoir rock fragments, from unconsolidated, or poorly consolidated reservoir rocks.

The subject method of creating the tall frac includes creating a linear-sourced, cylindrical stress field by maneuvering the intersection of two independent friction-controlled pressure gradients of a frac pad fluid. The intersection of these two frac pad fluid pressure gradients can be controlled when the frac pad fluid traverses along a well bore sandpacked annulus. The first pressure gradient is created by controlling the fluid flow rate and the consequent, friction pressure loss in the frac pad fluid flow through a portion of the sandpacked annulus, located above the top of the upwardly propagating tall frac hydraulic fracture. The first pressure gradient must be significantly greater than the average gradient of the formation, frac-extension pressure gradient. The second pressure gradient is created by the friction loss of the volume flow rate of the frac pad fluid flowing through the combined parallel paths of the sandpacked annulus and the open hydraulic fracture which is propagating outward in the adjacent rock formation below the top of the upwardly propagating tall frac. The second pressure gradient, below the top of the upward-propagating tall frac, should be about equal to or less than the average gradient of the formation, frac-extension pressure gradient at this location.

BRIEF DESCRIPTION OF THE DRAWINGS

The accompanying drawings illustrate complete preferred embodiments in the present invention according to the best modes presently devised for the practical application of the principles thereof, and in which:

FIG. 20A depicts a long, continuous tall frac growth along a sandpacked annulus around an uncemented casing over a depth of 8000 to 12,000 feet.

FIG. 20B depicts seven conventional fracs through perforated cemented casing in a multi-zone frac program over the depth of 8000 to 12,000 feet.

DETAILED DESCRIPTION OF THE PREFERRED EMBODIMENTS

The present invention provides a method for creating a tall frac extending vertically through a multiplicity of sand and shale formations. The tall frac method provides an intersection between two different fluid friction controlled pressure gradients. Frac pad fluid flow is used to traverse vertically along a well bore sandpacked annulus over an interval of the sand and shale formations and encompassed by the tall frac. The present invention provides a controlled fluidized bed method for creating the well bore sandpacked annulus used for creating the tall frac.

Figure 1:
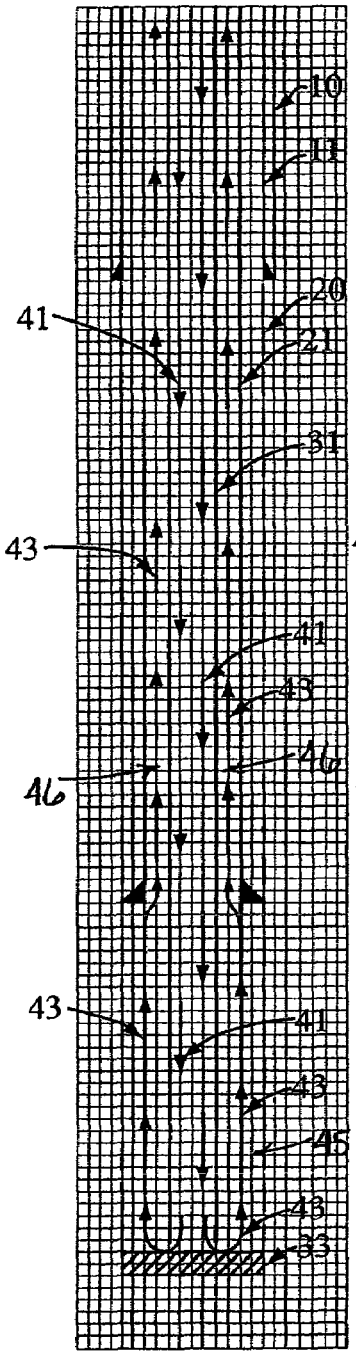
FIG. 1 depicts a typical well bore equipped with casing preparatory to emplacement of a continuous sandpacked annulus by the fluidized sand column method used in this invention.
Figure 2:
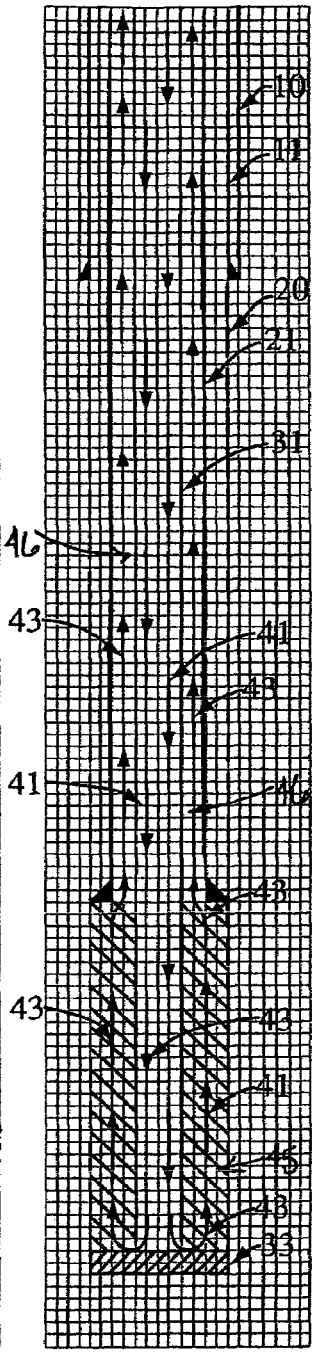
FIG. 2 depicts the well bore during the fluidized sand column emplacement of the sandpacked annulus.
Figure 3:
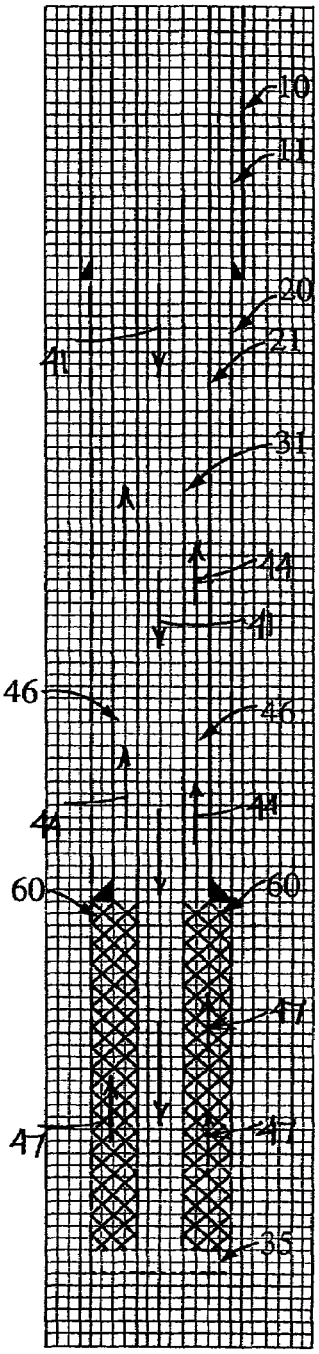
FIG. 3 depicts the well bore after the sandpacked annulus has settled into place, and a resin coating around the sand grains has cured to create a consolidated sandpacked annulus with high porosity and high permeability.

In FIGS. 1, 2, and 3, the mechanical configuration of the well bore and casing is illustrated for providing the fluid circulation paths needed to build a sandpacked annulus 60, a tall frac, and filling the tall frac with proppant sand using a fluidized bed methodology.

As shown in these drawings, a large-sized surface hole 10 is drilled and a surface casing 11 is set and cemented in place. A normal diameter drill hole 20, shown in dashed lines in the drawings, is then drilled to a desired depth. An intermediate diameter outer casing 21 is then set to the top of a prospective oil and/or gas producing interval, which is intended to be the tall frac completed for production. The outer casing 21 is cemented in place by conventional means to prevent the tall frac from being propagated through the formations above the bottom of the casing 21.

Finally, a long string of production casing 31 is run to the near bottom of the drill hole 20. Then, a very coarse-grained sand is circulated down the casing 31 to provide about 200 to 300 ft of sand fill 33 in the bottom of the drill hole 20. After the sand fill 33 has settled out to the bottom of the hole 20, the casing 31 is used to tag the top of the sand fill 50. The production casing 31 is then pulled up to a position of about 50 to 70 ft above the tagged top of the sand fill. The casings 11, 21 and 31 are now properly positioned to provide the desired geometry for creating the sandpacked annulus 60, which is initiated in the annulus space between the drill hole 20 and the production casing 31.

The fluidized bed method of building the sandpacked annulus 60 is accomplished by using an analytically determined volume flow rate of sand-laden water, shown as arrows 41, or alternatively using a viscosity-controlled hydraulic fluid, flowing downward 41 and inside and around a bottom 42 of the drill hole 20 below the production casing 31. An upward flow of sand laden water or hydraulic fluid, shown as arrows 43, is flowing upward through an open hole lower annulus 45. Also, water without most of its sand content is shown as arrows 44 flowing upward through a reduced open area annulus 46 between the casing 31 and the outer casing 21.

A bottom-hole, temperature-cured, resin-coated, uniform, coarse-grained sand, such as 8-12 mesh, 10-15 mesh, 12-18 mesh, 15-22 mesh, etc., can be selected to create the sandpacked annulus 60 with a desired fluid flow friction loss as designed for a desired, upward-growth rate and geometry of the tall frac discussed herein. The volume flow-rate for this upward-flowing water or alternative hydraulic fluid in the open hole annulus 45 should be analytically calculated or experimentally determined to create a fluidized bed sand content of about 50%, i.e., 50% sand volume and 50% water volume, in the largest, washed-out, cross-sectional-area cavities in the annulus. In the smaller cross-sectional areas of the annulus, the sand concentration may be much less, i.e., in a range of 10 to 30%.

Figure 4:
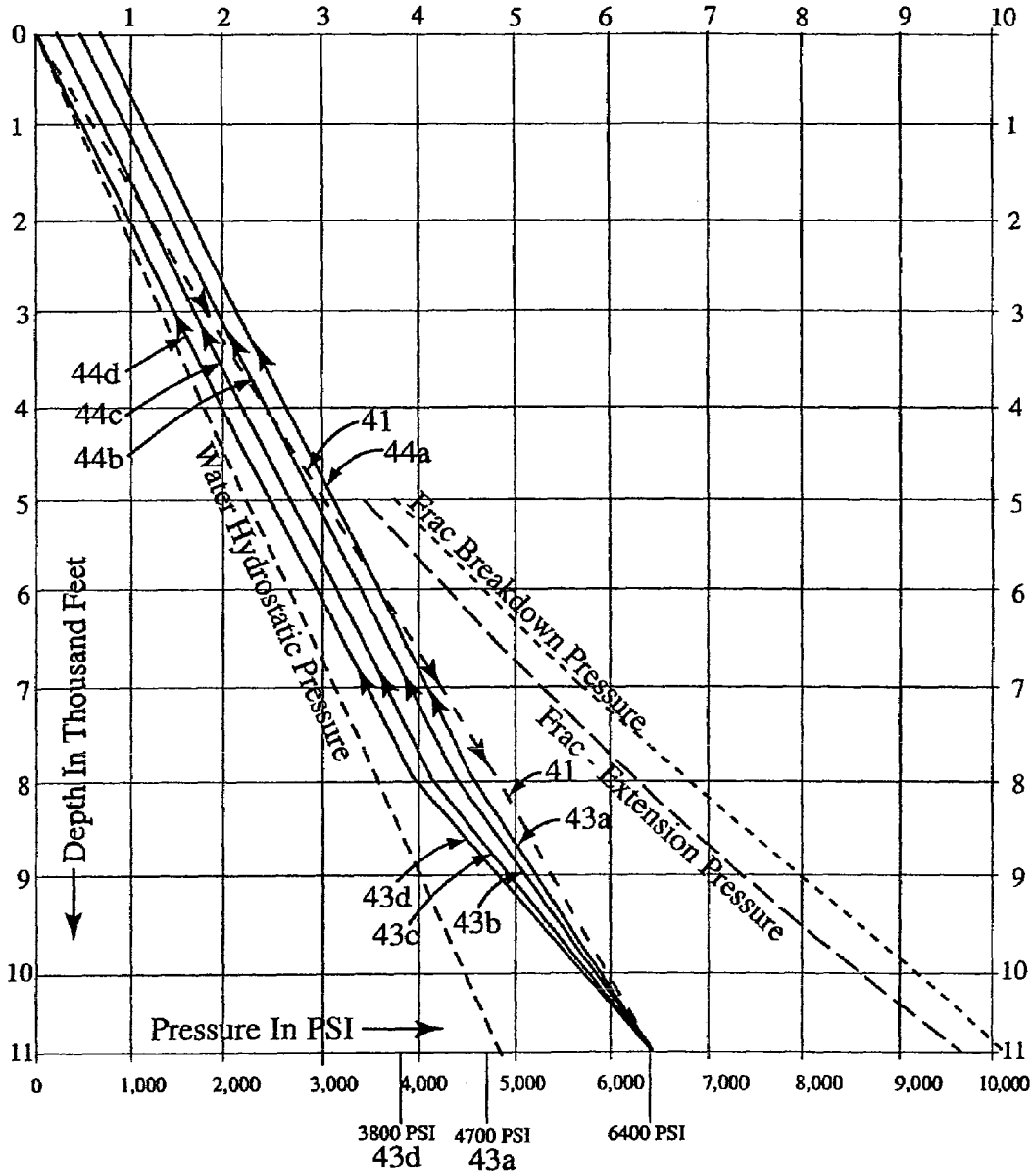
FIG. 4 depicts pressure gradient profiles for the well bore annulus at each of several stages of average sand concentration while building the sandpacked annulus by using a fluidized bed method.

In FIG. 4, typical average pressure gradients, shown as lines with arrows 43*a*, 43*b*, 43*c* and 43*d*, in the open bore annulus 45 are illustrated and at each of several stages of increasing sand concentration in the fluidized open bore annulus 45 as the sandpacked annulus is being created. A line 43-*a* represents an average pressure gradient in the annulus when the fluidized bed sand concentration averages about 30% of the total annulus cross-sectional area. When a water flow rate analytically determined to create a 30% sand concentration fluidized bed is used, a 30% fluidized bed of that concentration will start to accumulate at the bottom of the annulus 45 with the pressure gradient shown as 43*a*. With time, the fluidized bed will grow in height until it fills the total open hole interval from the base of the production casing 31 to the base of the outer casing 21. When the fluidized bed height reaches the base of the outer casing 21, as shown in FIG. 2, then the surplus sand will be carried upward in the open area annulus 46 by the much higher linear velocity of water flow 44 with relatively low sand concentrations. The open area annulus 46 is between the production casing 31 and the outer casing 21, as shown in FIGS. 2 and 3.

When the top of the initial fluidized bed reaches the base of the outer casing 21, the injected volume flow-rate is slowly decreased. This results in a gradual increase of sand concentration throughout the open bore annulus 45 in the process ultimately creating the sandpacked annulus 60, shown in FIG. 3. As the sand concentration throughout the fluidized bed gradually increases, the average pressure gradient, as shown in FIG. 4, gradually increases as illustrated in the curve progression from lines 43*a* to 43*b*, to 43*c*, to 43*d*. For example, the pressure difference of line 43*a* between 11,000 feet and 8000 feet is 1700 psi. Therefore, 1700 psi divided by 3000 feet equals 0.566 psi/foot, which is the average pressure gradient of line 43*a*. The pressure difference of line 43*d* between 11,000 feet and 8000 feet is 2600 psi. Therefore, 2600 psi divided by 3000 feet equals 0.866 psi/foot, which is the average pressure gradient of line 43*d*. In the enlarged, washed-out portions of the well bore, the fluid volume, flow-rate per unit of cross-sectional area is lowest resulting in the highest sand concentration and consequently the highest pressure gradient. It should be noted that lines 44*a*, 44*b*, 44*c* and 44*d* illustrate the average pressure gradients of the sand laden water 44 circulated through the upper open area annulus 44, shown in FIGS. 2 and 3.

When the volumetric sand concentration approaches 65%, the sand grains start to touch each other and thereby interfere with each other's motion in the fluidized bed. Consequently, in a portion of this enlarged annulus area, the sand concentration will increase to over about 65%, thereby creating the desired semi-solid sandpacked annulus. In the remaining portion of the annulus area, the sand concentration will decrease to under about 65%, thereby providing a sustained, fluidized bed, upward fluid flow. As the injected volume flow-rate is slowly decreased further, a portion of the annular area, filled with the semi-solid packed sand, will increase, and the portion of the annular area, filled with the fluidized bed column, will decrease.

With continuing decrease of the injected volume flow rate, eventually, a vertical, nearly continuous, semi-solid packed sand will occupy an increasing portion of the annulus area in all portions of the well bore, i.e., both the enlarged washed-out areas and the in-gage, not enlarged, portions of the well bore. Also, the vertically continuous, fluidized bed column will occupy a decreasing portion of the annulus area in all portions of the well bore. At some point when the portion of the annulus area, occupied by the fluidized bed column, becomes too small, an instability will develop in the lower open bore annulus 45 causing the semi-solid packed sand to collapse into the adjacent fluidized bed, thereby abruptly terminating the fluidized bed-column fluid flow and thereby create the nearly continuous sandpacked annulus 60 shown in FIG. 3. Then, the semi-solid packed sand will settle, resulting in some voids in the annulus not filled with continuous packed sand. These voids in the sandpacked annulus 60 will generally occur near the top of the in-gage sand sections just below the base of the enlarged, washed-out sections.

Large diameter, wash-out zones cause fluidized bed instability and thereby limit the extent of the sandpacked annulus continuity, resulting in increased area of annulus voids. Therefore, special effort should be made to optimize drilling mud chemistry, mud hydraulics, and drilling technology to drill a more uniform, well bore, in-gage hole without significant, enlarged-diameter, washed-out zones and thereby achieve a more continuous and uniform well bore sandpacked annulus 60.

In the upper open area annulus 46, shown in FIG. 3, between the production casing 31 and the outer casing 21, the buildup of a sand concentration in a fluidized bed is avoided by maintaining a vertical linear velocity of the sand laden water 44 greater than the terminal velocity of the sand falling through this fluid. So long as this minimum, linear, fluid velocity is maintained in excess of the sand free-fall velocity and all excess sand reaching the base of the outer casing 21 will be carried up the upper open area annulus 46 to the surface and out to a fluid storage tank. The fluid storage tank is not shown in the drawings. When the fluidized semi-solid sandpacked annulus 60 reaches a stabilized sand content for a given fluid volume flow-rate, then the excess sand-slurry concentration rate and the expulsion rate up the annulus 46 to the surface, will be equal to the sand slurry concentration and injection rate of the sand-laden water 41 downward inside the production casing 31.

At the start of developing the sandpacked annulus 60, the downward slurry of sand-laden water 41 may have a sand concentration of about 20% of the slurry volume. As the development of the fluidized bed concentration progresses, the sand laden water 41 concentration may be progressively reduced from 20% down to 0%, as the fluid-volume injection rate is being simultaneously reduced to increase the sand concentration in the lower open area annulus 45. The objective of designing the injection flow rate and the sand concentration for a specific well geometry is to arrive at a sand concentration in the slurry expulsion up the open area annulus 46 to the surface to be less than about 3% and, preferably, as close to 0% as possible. Then, when the fluidized bed in the lower open bore annulus 45 collapses to create the sandpacked annulus 60, the volume of sand in the upper open area annulus 46 will be as small as possible.

In each specific well, a hydraulic design engineer can design the sandpacked annulus permeability and the annulus fluid transmissibility to be large enough to provide a sufficient, fluid volume flow-rate to sustain an upward fluid flow linear velocity in the annulus 46 greater than the terminal velocity of this sand falling downwardly through the fluid. When correctly designed to achieve this objective, then all excess sand located in the upper open hole annulus 46 can be expelled at the surface thereby causing the upper annulus 46 to be free of any sand.

When the fluidized bed of the lower open bore area annulus 45 has collapsed to create the nearly continuous sandpacked annulus 60 and the upper open area annulus 46 has been cleared of any sand content, then fluid circulation down the inside of the casing 31 and up through the lower sandpacked annulus 60 and the upper open area annulus 46 can be terminated. Then, over the next few days at the normal well bore bottom hole temperature, a resin coating applied around the sand grains in the lower sandpacked annulus 60 can be cured to create a non-moveable, consolidated, sandpacked annulus with very high porosity, permeability, and fluid transmissibility.

After all fluid flow has been terminated and prior to the resin curing, the sandpacked annulus 60 may settle in some areas, creating some void spaces therein. Such void spaces, scattered at intervals up and down the annulus, become part of the overall annulus' average fluid-transmissibility property. However, it may be desirable to fill the topmost void space in the annulus 60 at the base of the outer casing 21, if that void space has direct continuity with the total void space of the upper open area annulus 46. This filling of any void space in the annulus 60 can be accomplished by circulating fluid with a low concentration of sand down the upper annulus 46 and into the top of the lower sandpacked annulus 60 until the void is filled. At this time, the fluid flow direction can be reversed to displace any surplus sand left inside the upper annulus 46. Obviously, the objective is to end up with the top of the lower annulus 60 completely filled with consolidated sand packed therein and keep the upper annulus 46 essentially empty of any sand.

This fluidized bed method of building a sandpacked annulus 60 can also be used for gravel-pack and other well bore applications. In gravel-pack and other well bore application, the particle grain size, fluid viscosity, casing sizes, annulus area, and other hydraulic design factors can be varied and selected to optimize the fluidized bed implantation process and the consequent, gravel-pack mechanical and hydraulic properties.

After the resin coating around the sand grains has cured, to create a non-moveable, consolidated sandpacked annulus 60, a drill-string or completion tubing with drill bit can be used to drill out any residual, consolidated, resin-coated sand near the bottom of the production casing 31 and to circulate out the sand fill 33, shown in FIGS. 1 and 2. When the sand fill 33 is removed, an open hole 35 is created for ease in the circulation of a frac pad fluid upwardly through the bottom of the annulus 60. The open hole 35 is shown in FIG. 3. Also, frac fluid water with a frac proppant sand can be later injected through the open hole 35 out into the hydraulic fracture to provide a proppant to hold open the frac.

Figure 5:
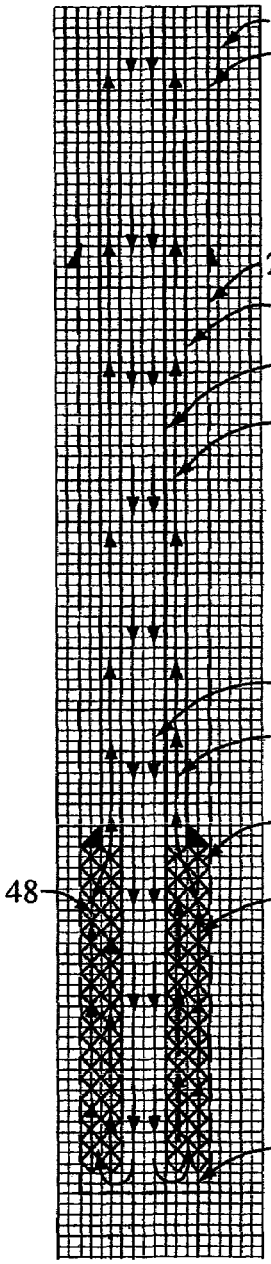
FIG. 5 depicts the well bore during the sandpacked annulus, flow-evaluation testing. The testing is to determine the fluid transmissibility and the average friction-loss characteristics of the sandpacked annulus.
Figure 6:
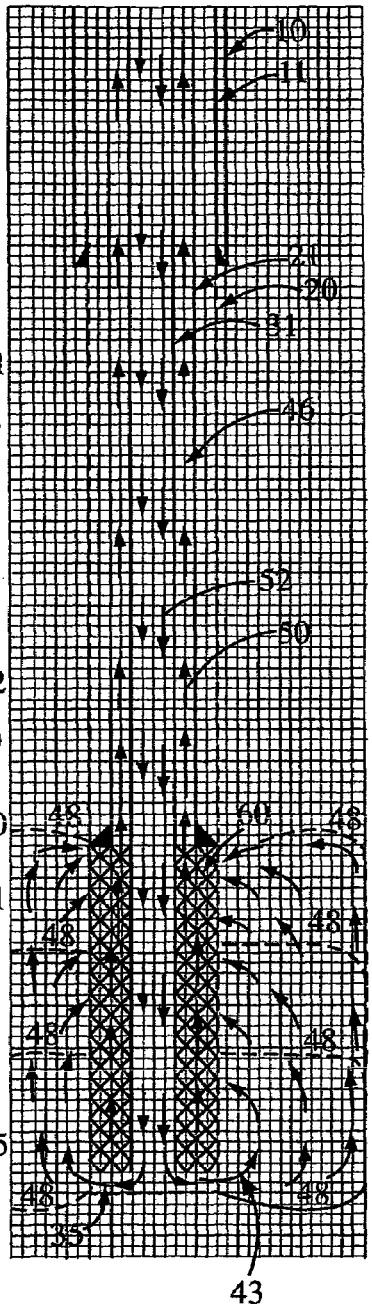
FIG. 6 depicts the well bore during the process of vertically growing the hydraulic fracture upward along the well bore sandpacked annulus to create the tall frac.

In FIG. 5, a frac pad fluid flow is shown flowing downward as frac pad fluid injection flow, shown as arrows 52, through the production casing 31. The frac pad fluid flow, shown as arrows 51, is shown flowing upward through the sandpacked annulus 60. The frac pad fluid discharge flow, shown as arrows 50, is shown flowing upward through the upper open area annulus 46 between the production casing 31 and outer casing 21.

Figure 9:
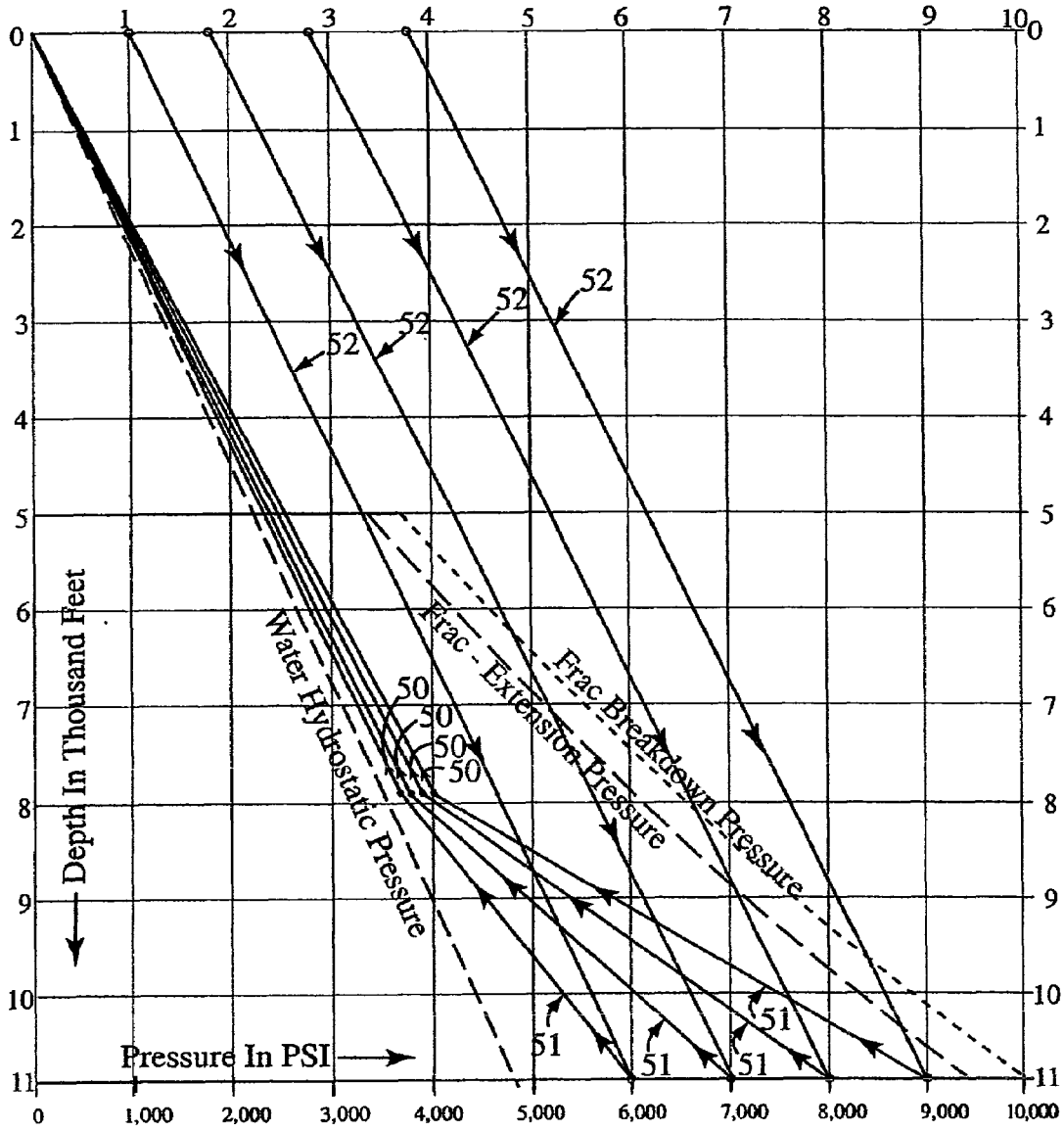
FIG. 9 depicts a pressure gradient profile in the sandpacked annulus at flow rates and bottom-hole pressures at or below the frac-initiation pressures and flow rates.

Referring forward to FIG. 9, this drawing illustrates a pressure gradient of the frac pad fluid flow circulated downward, shown as arrows 52, through the production casing 31 and upwardly, shown as arrows 51, through the consolidated sandpacked annulus 60 for each of four different volume flow-rates, as established by four selected and different surface-injection pressures. The fluid-transmissibility of the sandpacked annulus 60 and other useful hydrodynamic properties can be calculated from the flow-rate and pressure data recorded from the measurements made during the testing operations as depicted in this drawing. From this hydrodynamic data, the hydraulic design engineer can determine frac pad fluid viscosity needed to achieve a desired, average pressure gradient of the frac pad fluid flow 51 in the sandpacked annulus 60 and the frac pad fluid pumping rate selected for frac-pad breakdown and tall frac growth.

In designing future wells to be drilled and completed, using the tall frac technology described herein, a hydraulic-design engineer can select alternative drill-hole diameters, casing sizes, sand-grain mesh sizes and frac pad fluid viscosity to establish the desired frac pad fluid pumping rate to achieve the required average pressure gradient for frac breakdown and controlled tall frac growth. The controlled tall frac growth is illustrated in FIGS. 10, 11, 12, and 13.

After a well is drilled, the outer casing 21 and the production casing 31 have been set, and the sandpacked annulus 60 has been emplaced over an open-hole section to be completed with the tall frac, the frac pad fluid viscosity and the frac pad fluid injection rates are then the only remaining variables for the hydraulic engineer to select in order to achieve the desired pressure gradients for controlling the tall frac growth.

It should be mentioned that an increase in frac pad fluid viscosity results in a decrease in the injected, frac pad fluid pumping rates to achieve a desired pressure gradient through the sandpacked annulus 60. This feature helps reduce frac-pump horsepower and related costs. Also, an increase in frac pad fluid viscosity provides an increased ratio between fluid transmissibility in the geological formation hydraulic fracture and the fluid transmissibility in the sandpacked annulus 60, thereby increasing the proportion of frac pad fluid flowing through the hydraulic fracture compared to that flowing through a parallel path through the sandpacked annulus 60.

Referring back to FIG. 5, the desired frac pad fluid viscosity and pumping rates must be established and stabilized by displacing all prior well bore fluids before initiating the tall frac operation. The pumping rate and pressure can then be increased to initiate the formation of a hydraulic fracture 49 using a frac breakdown and frac-extension pressure of the frac pad fluid flow 48 depicted at an 11,000-ft depth in FIG. 10. The volume rate of the frac pad fluid discharge flow, shown as arrows 50, must be monitored and maintained at a constant rate by adjusting a rate of the frac pad fluid injection flow, shown as arrows 52.

The formation of the hydraulic fracture 49 or fractures 49 is the "tall frac" discussed herein. Throughout this discussion, the fracture 49 or fractures 49 is used interchangeably with the new term "tall frac".

The difference between the frac pad fluid injection flow 52 and the frac pad fluid discharge flow 50 is the volumetric rate of growth of the hydraulic fracture less fluid losses by leak-off into porous formation zones. In most tight oil and/or gas formations requiring a tall frac operation, the formation fluid loss is minor.

Figure 10:
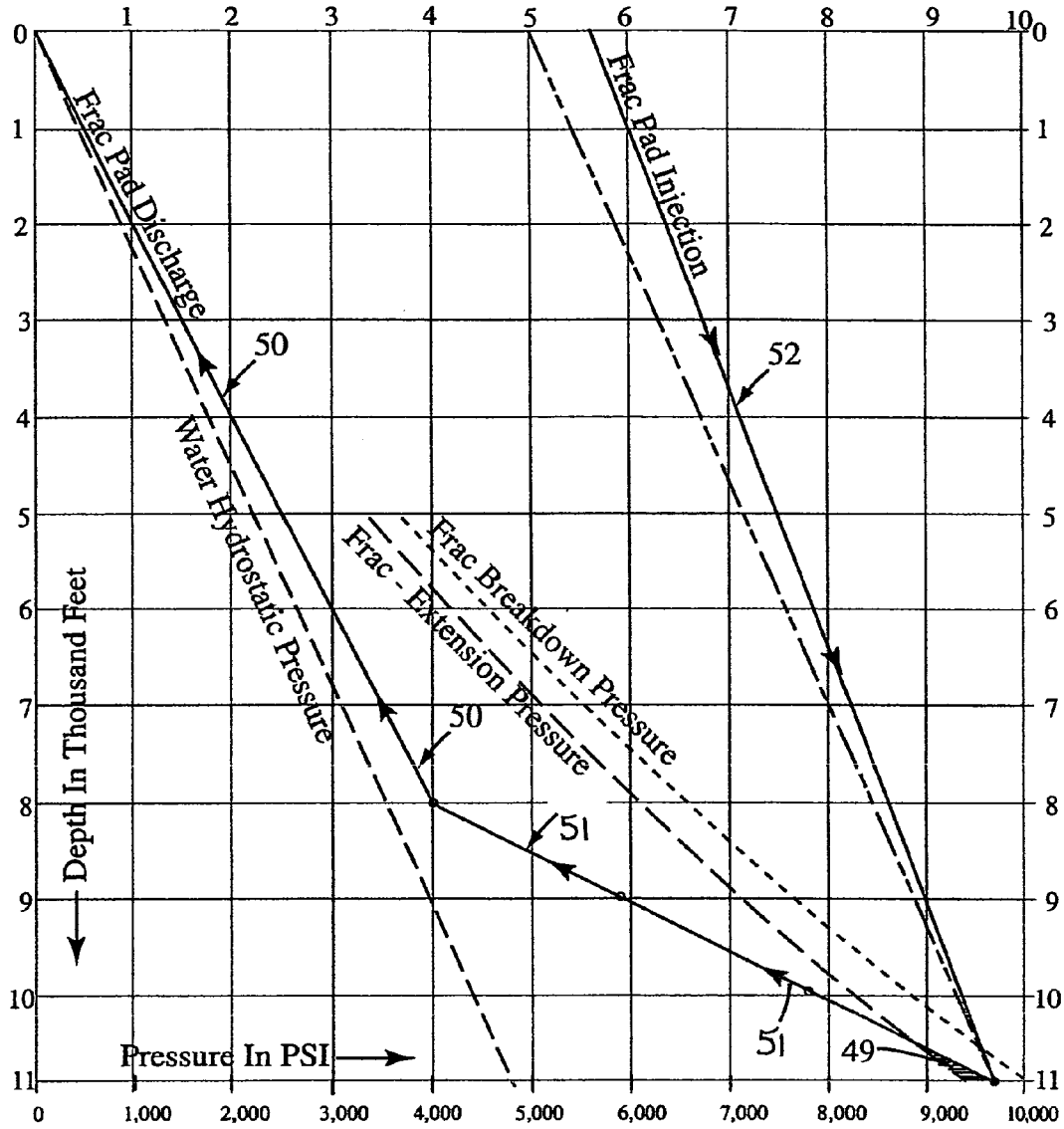
FIG. 10 depicts the pressure gradient profile in the sandpacked annulus at flow rates and bottom hole pressures after frac breakdown and during an early growth stage of the tall frac.

In FIG. 10, the pressure in the frac pad fluid flow, shown as arrows 51, in the sandpacked annulus 60 exceeds the frac-extension pressure for a distance of about 400 ft above the bottom of the hole, thereby initiating and propagating the hydraulic fracture 49 or the tall frac over this vertical interval. At all elevations above this 400-ft interval, the frac pad fluid flow 51 at predetermined volume rates and pressure gradients through the permeable sandpacked annulus 60, will have pressures below the formation frac-extension pressure, thereby preventing any further vertical growth above this 400-ft interval. Further growth of the hydraulic fracture 49 can be created by holding an increasing back pressure on the frac pad fluid discharge flow 50 being discharged from the upper open area annulus 46 at the surface.

Figure 11:
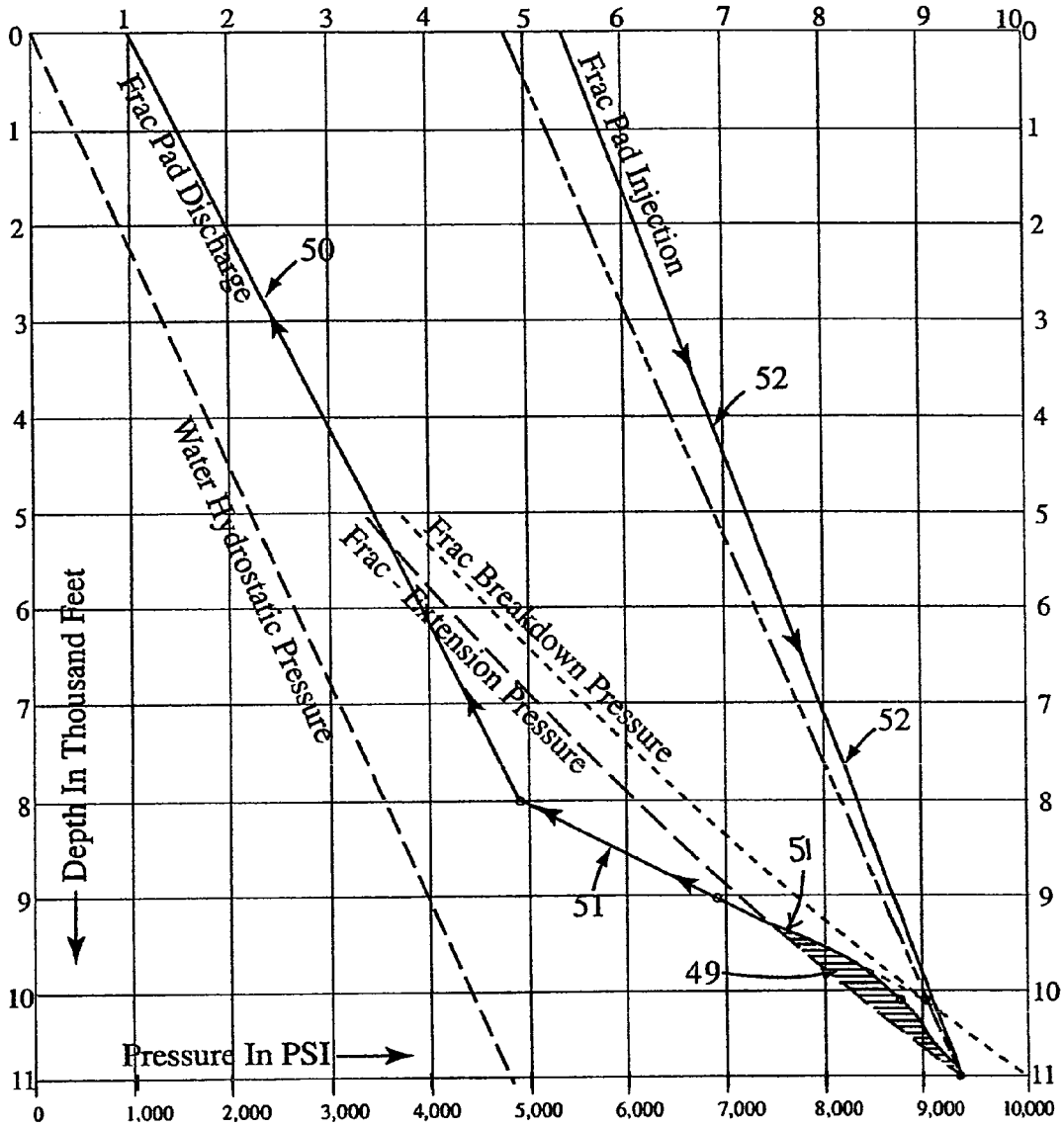
FIG. 11 depicts the pressure gradient profile in the sandpacked annulus after the tall frac has grown to a height of about 1,000 ft.

In FIG. 11, the hydraulic fracture 49 or tall frac is shown growing upward along the sandpacked annulus 60 about 1.2 ft per each 1 psi increase of the pressure of the frac pad fluid discharge flow 50 at the surface. When the pressure of the discharge flow 50 has increased by 1,000 psi, as shown in this drawing, the top of the hydraulic fracture 49 or tall frac will have moved upward about 1,200 ft or from 10,600-ft depth up to about 9,400-ft depth. Throughout this 1,200-ft interval, a cylindrical, radially outward, stress field exists, thereby propagating the hydraulic fracture 49 in a plane encompassing the well bore as a "line source" and in a direction perpendicular to the least-principal stress existing in a plane perpendicular to the well bore axis. If the well bore is vertical, this cylindrically stressed tall frac created by a long-line source, will be a frac plane in the same direction as a spherically stressed, frac direction, created by a point source set of perforations in a cemented casing. Again, since the pressure of the frac pad fluid flow 51 in the permeable sandpacked annulus 60, above the depth of 9,400 ft in this drawing, is below the formation frac-extension pressure, the tall frac cannot be propagated above this elevation.

In FIGS. 10-13, as the back pressure on the frac pad fluid discharge flow 50 is slowly increased, the hydraulic fracture 49 grows controllably upward along the annulus 60 at a rate of about 1.2 to 1.5-ft of vertical growth per each psi increase of back pressure. However, at any given back pressure, the frac pad fluid flow injected into the hydraulic fracture 49 and not discharged, shown as arrows 50, up the upper open area annulus 46, results in the horizontal growth of the hydraulic fracture 49. Therefore, the relative rates of horizontal growth, compared to the rates of vertical growth, can be controlled by the net volume of frac pad fluid injected into the hydraulic fracture compared to the rate of increase of back pressure on the frac pad fluid discharge flow 50.

Figure 12:
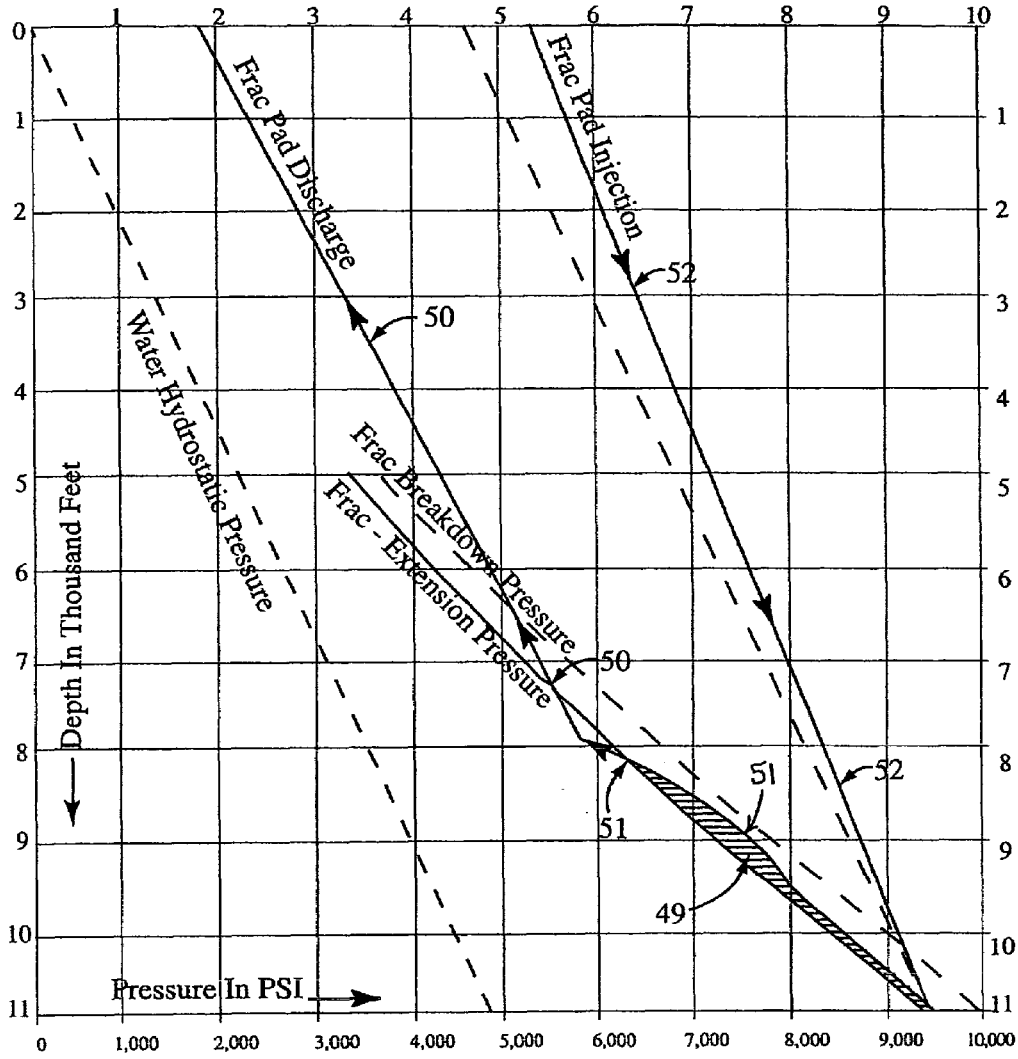
FIG. 12 depicts the pressure gradient profile in the sandpacked annulus after the tall frac has grown to a height of about 2,000 ft or about ⅔ of the height of the total interval to be tall frac completed.

In FIGS. 11 and 12, it is observed that in the lower part of the hydraulic fracture 49 or the tall frac, the pressure on the frac pad fluid 51 is slightly higher than the frac-extension pressure, but has substantially the same pressure gradient. In the upper portion of the hydraulic fracture 49, the fluid pressure exceeds the frac-extension pressure by a sufficient amount to cause the tall frac to grow vertically and horizontally to achieve a maximum fracture width. At this position, and below this position in the fracture 49, the fluid transmissibility in the hydraulic frac pad fluid flow 48 is large compared to the frac pad fluid 48 transmissibility in a parallel path in the sandpacked annulus 60. Therefore, the friction loss and the pressure gradient are less in the tall frac than what exists in the sandpacked annulus 60 above the top of the growing tall frac.

The consequent decrease in the difference between the pressure of the frac pad fluid flow 51 and the frac-extension pressure in the lower part of the fracture 49 results in the tall frac width decreasing. Therefore, by the natural rock mechanics process automatically adjusting the fluid transmissibility in that portion of the fracture until the fluid pressure gradient of the frac pad fluid flow substantially, parallels the frac-extension pressure gradient and the width of the tall frac is thereby controlled. For example in FIG. 12, at about 9,000-ft depth, the maximum, hydraulic-fracture width may be about 0.2 to 0.3-inch wide with very high fluid transmissibility, whereas from 10,000 ft to 11,000 ft, the fracture width may be reduced to about 0.05 to 0.1 inch (or less) with relatively low fluid transmissibility as may be needed for the consequent, fluid pressure gradient to substantially parallel the frac-extension pressure gradient.

Figure 13:
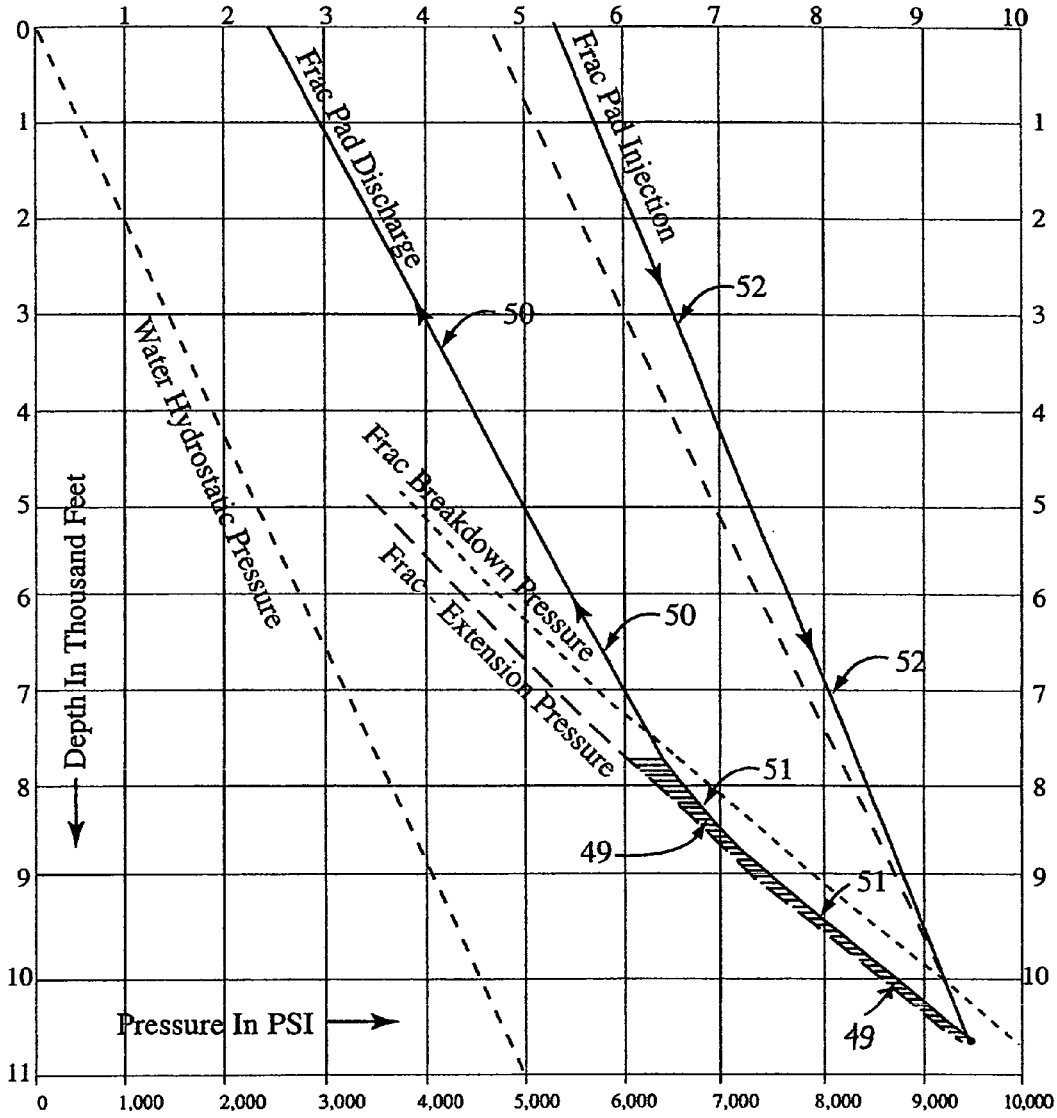
FIG. 13 depicts the pressure gradient profile in the sandpacked annulus after the tall frac has grown to a 3,000-ft height covering a total interval to be tall frac completed.

In FIG. 13, the tall frac is shown having grown vertically to its maximum height and just below the bottom of the outer casing 21 set at about 8,000 ft. The rate of the tall frac horizontal growth is controlled by the rate of increase in the net volume of frac pad fluid injection flow, shown as arrows 52, injected into the hydraulic fracture 49, minus the discharge rate of the frac pad fluid discharge flow, shown as arrows 50, and minus the rate of fluid loss into the sand and shale formations.

By controlling the rate of increase in the frac pad fluid net volume stored in the fracture 49, compared to the rate of vertical growth, the hydraulic design engineer can create the desired frac geometry, including tall frac horizontal length and tall frac height. For example, the initial horizontal tall frac length may be designed to average about 75 ft with a height of 3,000 ft. If the partially collapsed average width in the lower portions of the tall frac is about 0.1 inch, then the frac pad fluid flow volume stored in this fracture can be about 350 barrels. The total volume of frac pad fluid flow pumped into the hydraulic 49, may be 2 or 3 times the 350 barrel volume of which the difference between the total pumped frac pad fluid and the fluid stored in the fracture or lost by leakage into the formation is discharged to the surface through the open area annulus 46 and then recycled through a pump for reinjection down casing 31.

Figure 8:
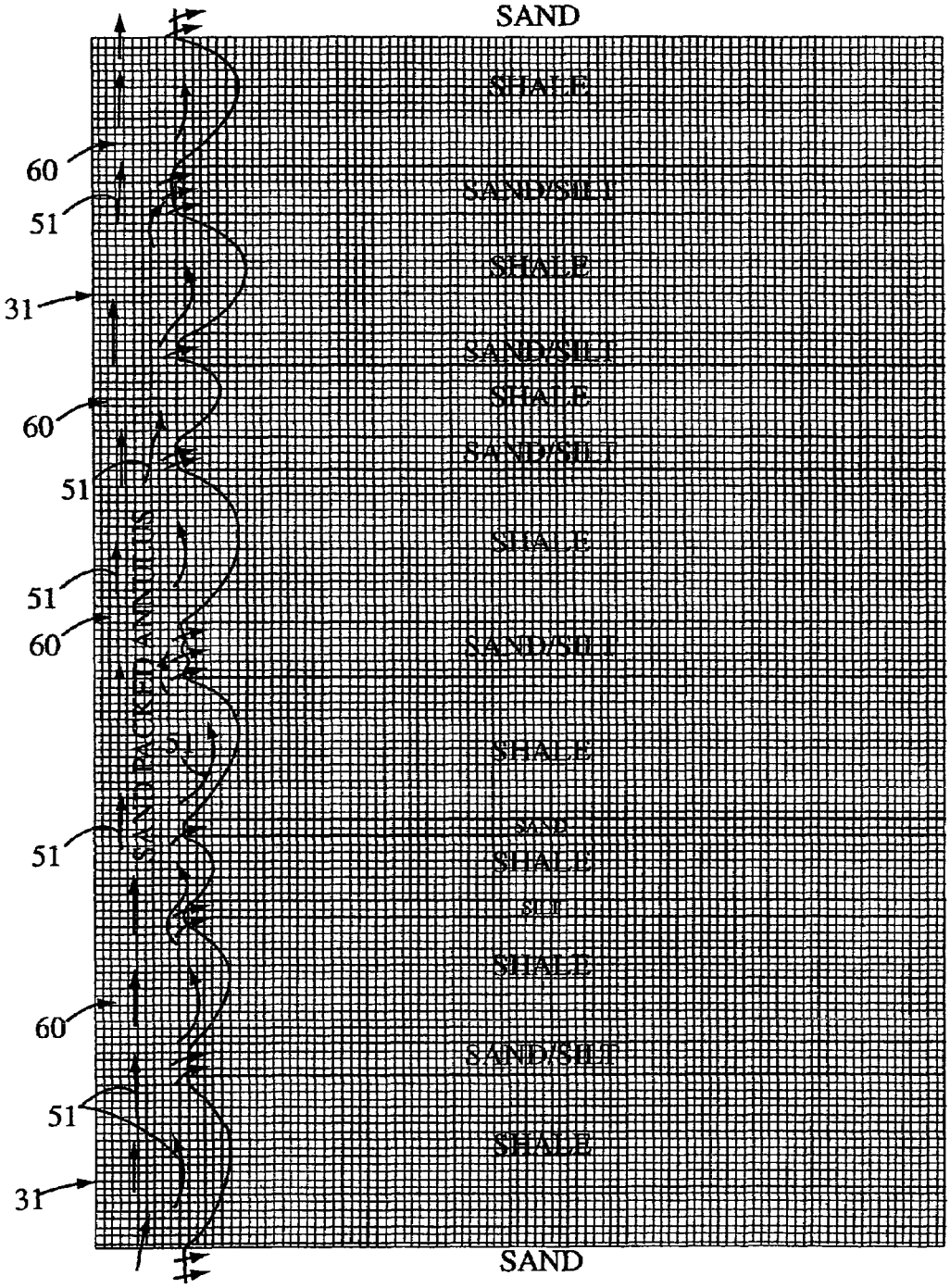
FIG. 8 depicts the process of initiating hydraulic fractures or the tall frac into sand and shale formation from the pressurized sandpacked annulus.

Referring back to FIG. 8, the frac pad fluid 51 is shown flowing through the sandpacked annulus 60. As the tall frac grows upward along the sandpacked annulus 60, the pressure of the frac pad fluid 51 in the sandpacked annulus 60 increases up to the frac breakdown pressure of some of the sand/silt stringers in the shale. When the sand/silt stringers breakdown to imitate a hydraulic fracture, then as the initial fractures grow outwardly, they will cause a frac breakdown through the intervening shale zones. This will create a continuous hydraulic frac through a thick shale barrier, which could not be penetrated by prior conventional frac technologies. To penetrate such frac barriers, it is essential to use the sandpacked annulus 60 to initiate the cylindrical stress fracture inot the sand/silt stringers in such barriers. This provide the means to establish a continuous tall frac across a multiplicity of reservoirs and shale barriers.

Figure 7:
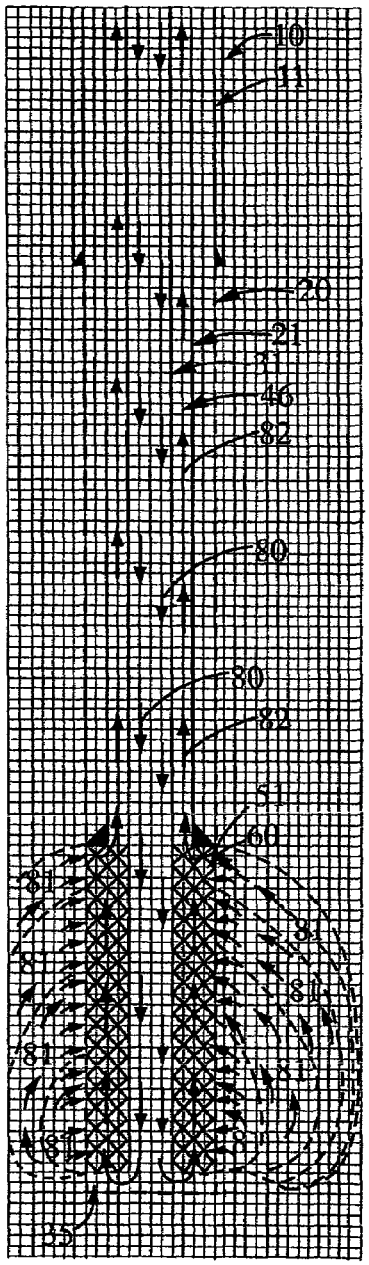
FIG. 7 depicts the well bore during the process of creating a frac-pack of proppant sand in the tall frac.

In FIG. 7, a step of creating a frac sand pack or frac-pack with proppant sand or other proppant materials, shown as arrows 81, circulating in the hydraulic fracture 49 and accumulating as a proppant pack adjacent to the sandpacked annulus 60 is illustrated. In this drawing, a frac pad fluid with proppant sand, shown as arrows 80, is circulated under pressure downwardly through the production casing 31 and into the surrounding propagated hydraulic fracture 49. The frac pad fluid 81 is shown flowing in fracture 49 outwardly, upwardly and inwardly toward the sandpacked annulus 60. The sand in the frac pad fluid is screened out and accumulates in the fractures adjacent to the sandpacked annulus 60 building a sand pack outwardly therefrom and into the hydraulic fracture of the tall frac 49.

An increasing friction loss in the frac pad fluid 81 flowing through the growing sand pack 81 will rapidly reduce the flow through the fracture to the sand pack where the existing sand pack is the longest, thereby reducing the rate of deposition of additional sand in the area. This will then direct most of the subsequent frac pad fluid with sand 45 to an area where the existing sand pack is the shortest. This will allow more rapid sand build up in this area of the tall frac. By this natural friction controlled sand pack growth, the sand pack 81 will grow more uniformly outward from the sandpacked annulus 60 and fill the full height and part of the horizontal length of the tall frac.

Figure 14:
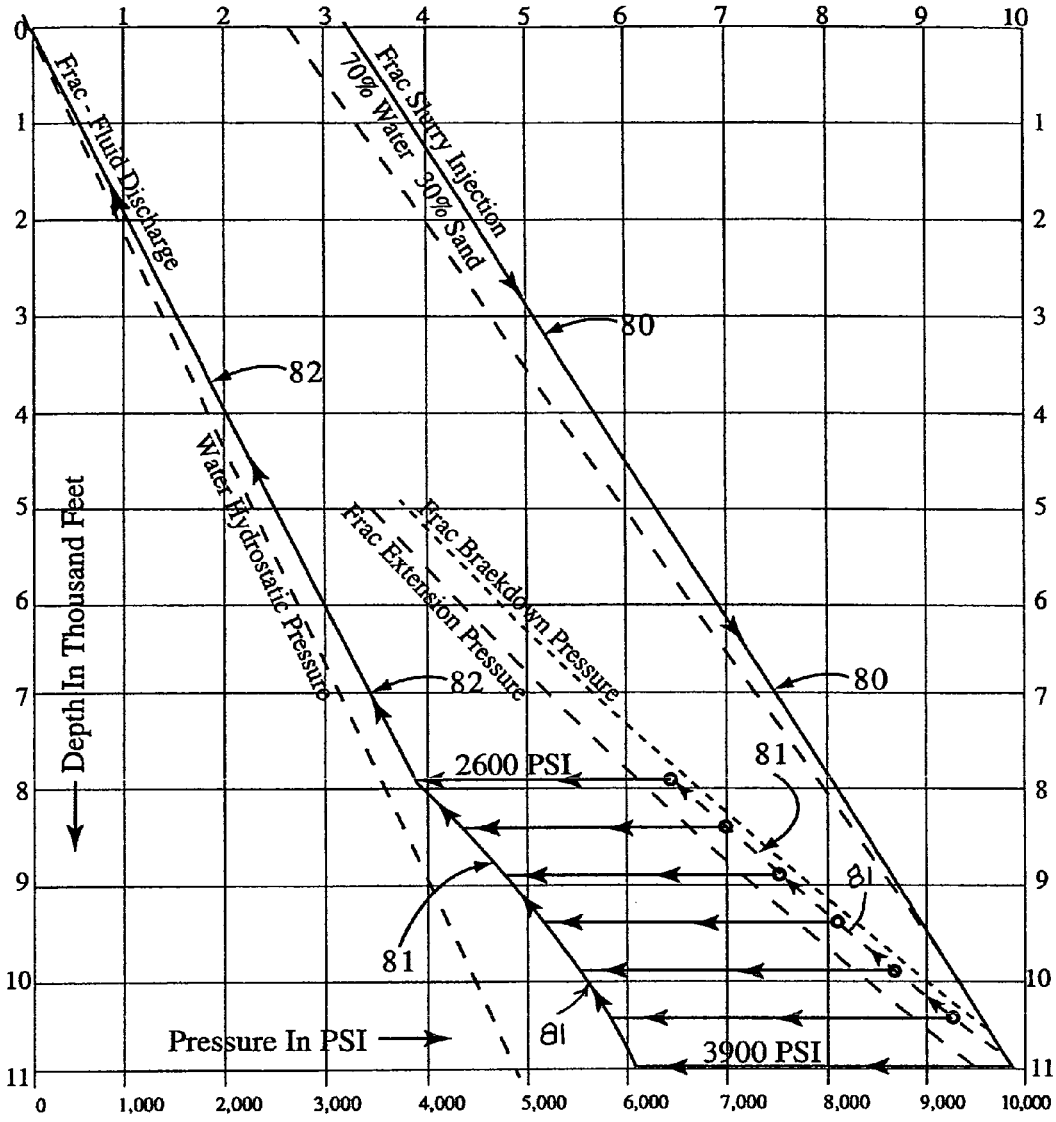
FIG. 14 depicts the pressure gradient profile in the sandpacked annulus and at a frac-sandpacked open face during the filling of the tall frac with sand or other granulated proppant.
Figure 15:
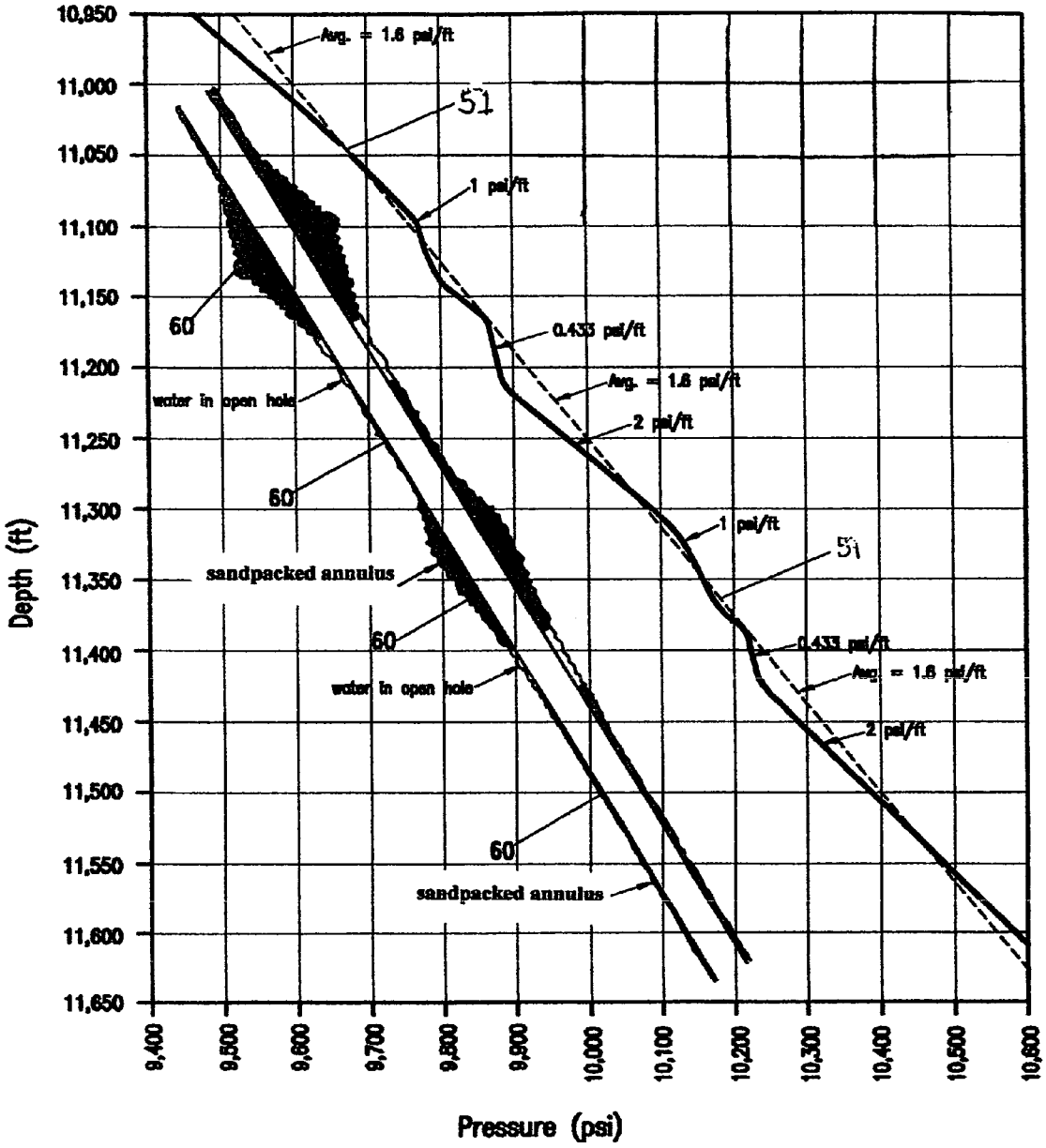
FIG. 15 depicts the sandpacked annulus pressure gradients during fluid transmissibility testing prior to initiating tall frac growth in a directionally deviated well bore.
Figure 16:
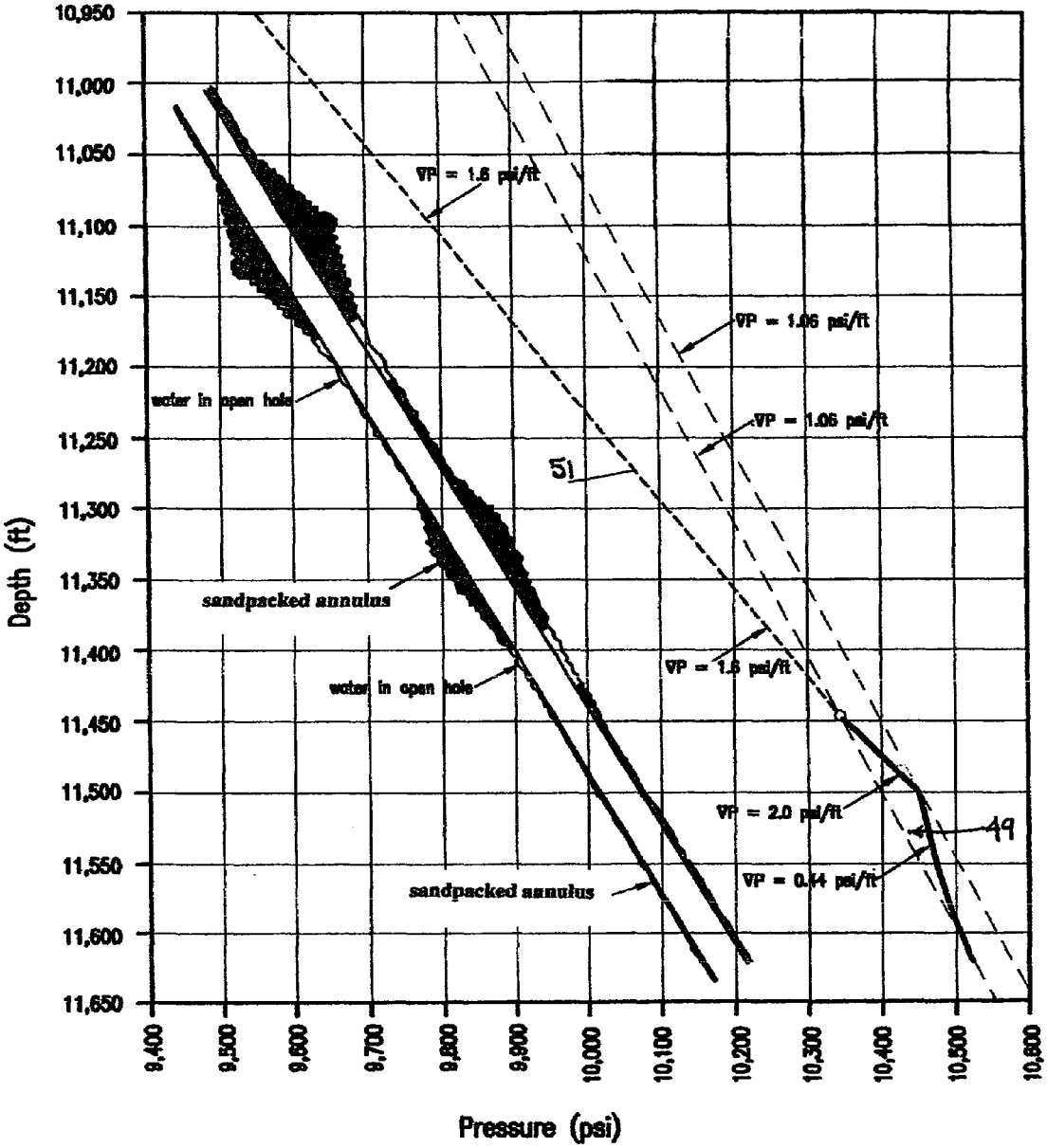
FIG. 16 depicts the sandpacked annulus pressure gradients during the initiation of tall frac growth next to the sandpacked annulus of the directionally deviated well bore as shown in FIG. 15.
Figure 17:
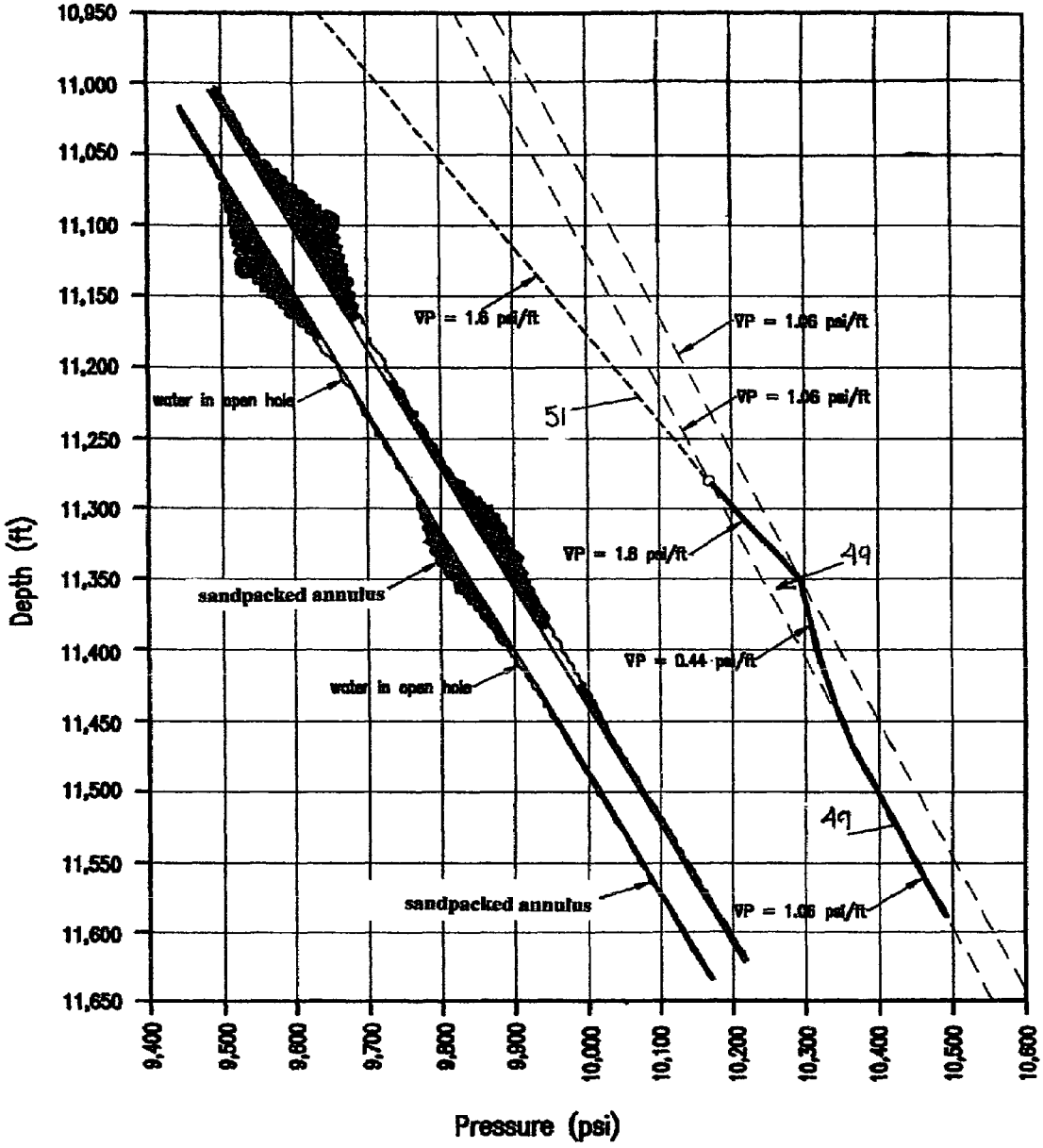
FIG. 17 depicts the sandpacked annulus pressure gradients as the tall frac growth progresses upward along the directionally deviated well bore.
Figure 18:
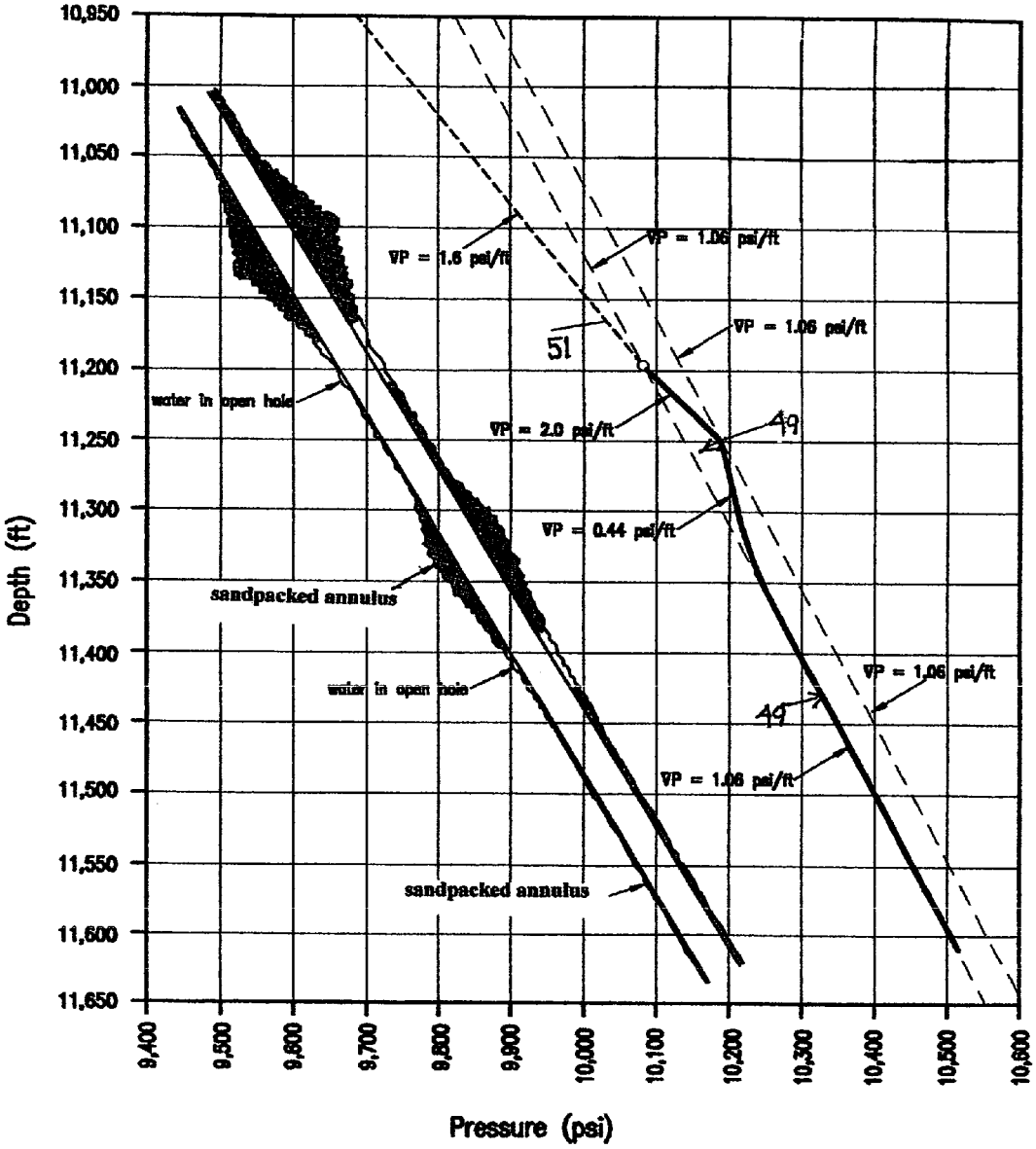
FIG. 18 depicts the sandpacked annulus pressure gradients as the tall frac growth progresses further along the sandpacked annulus of the directionally deviated well bore as shown in FIGS. 15-17.
Figure 19:
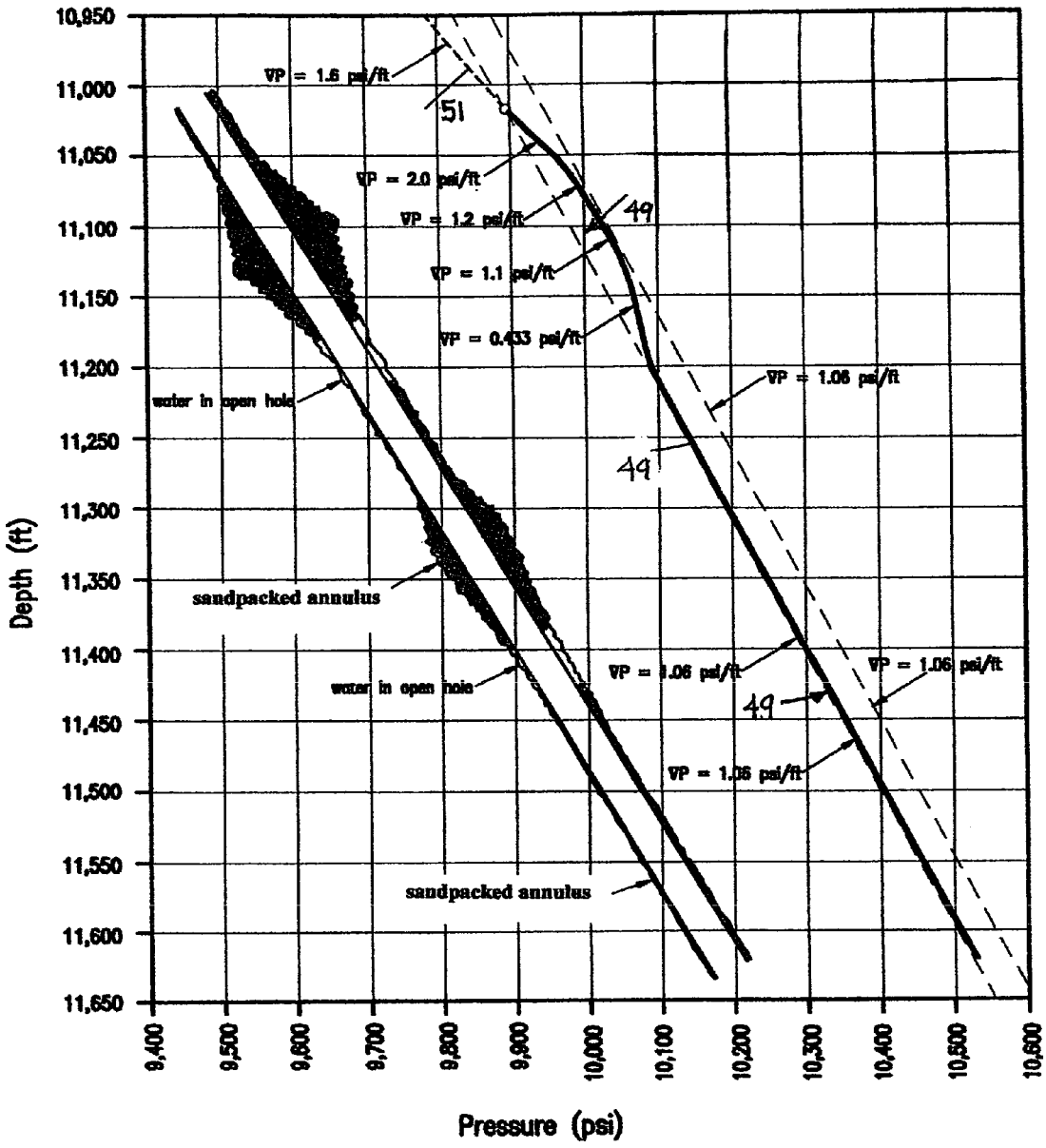
FIG. 19 depicts the sandpacked annulus pressure gradients as the tall frac growth progresses even further along the sandpacked annulus of the directionally deviated well bore as shown in FIGS. 15-18.

As the horizontal length of the frac sand pack 81 is increased, the pressure in the sand packed annulus 60 can be progressively reduced by gradually decreasing the back pressure on the frac pad fluid discharge flow 82, as illustrated in FIG. 14. At the start of building the sand pack 81 in the hydraulic fracture 49, the frac pad fluid discharge flow 50 pressure and the frac pad fluid flow pressures can be substantially as illustrated in FIG. 13. As the sand pack develops to greater, horizontal lengths in the formation hydraulic fracture 49, the frac pad fluid discharge flow 82 pressure is gradually reduced until it and the frac pad fluid flow pressures are reached as depicted in FIG. 14.

In FIG. 14, the pressure drop from horizontal flow of the frac pad fluid through the growing frac sand pack 81 in the hydraulic fracture 49 may be about 3,900 psi at 11,000 ft near the bottom of the tall frac to about 2,600 psi at 8,000 ft near the top of the tall frac. As shown in the drawings, the tall frac can cover a total, continuous height of in a range of 500 ft to 5,000 ft and a horizontal length in a range of 50 ft to 200 ft. The proppant sand width in the hydraulic fracture 49 is in a range of 0.1 to 0.3 inches. As an example, a typical tall frac can have a sand pack volume of about 7,800 cu ft, containing about 785,000 pounds of frac sand, covering a propped frac area of about 375,000 sq ft. If the pumped frac slurry consists of 30% sand and 70% water, then the total, injected frac slurry would be about 2,785 bbls of which about 1,950 bbls would be frac water and 835 bbls (or 4,690 cu ft, or 785,000 lbs) of proppant sand.

At the end of pumping the frac pad fluid with sand 80, a cementing-type casing plug can be pumped to the bottom with displacement water to be seated and locked in the bottom of the production casing 31. This casing plug will prevent backflow production of sand out of the frac sand pack. The balance of the frac fluid 82 can then be discharged up the open area annulus 46 to the surface. The formation gas flow can be initiated through the frac sand pack into the sandpacked annulus 60 and up the annulus 46 to the surface.

For final completion, the production casing 31 can be perforated at any desired location and interval so as to optimize this well's production capacity. Then, the formation gas will flow from the formation porosity zones and into the sand pack in the tall frac, into the high-transmissibility sandpacked annulus 60, and then through the casing perforations and into the production casing 31 for controlled, optimum production up casing 31 to the surface.

In FIGS. 15, 16, 17, 18, and 19, the tall frac growth pattern is illustrated in greater detail for a deviated well bore. These drawings can be compared to the vertical well bore shown in FIGS. 9, 10, 11, and 12. However, FIGS. 15, 16, 17, 18, and 19 also illustrate a variation in the sandpacked annulus gradient per foot of vertical elevation difference caused by an enlarged diameter well bore with wash-out zones and discontinuities in the sandpacked annulus 60. Since a fracture plane of the sandpacked annulus, injection, line-source fracture must always include a well bore axis, the high angle deviated well bore tall frac is predetermined to be propagated in a direction of the deviated, well bore drilling. Consequently, the directionally controlled deviated well bore can be drilled in a predetermined direction to intersect a maximum number of natural fractures and other favorable geological features.

The selective propagation of a fracture along the well bore axis can be done only using the sandpacked annulus 60 and the injection, line-source created tall frac. This type of fracture propagation can't be done using a typical frac pad fluid injection through perforations of a cemented casing. A conventional fracture created by a spherical stress field generated from a point-source, frac pad fluid injection through perforations in an annulus cemented casing will always propagate the fracture in a direction perpendicular to the minimum geological-stress direction in the rock formation with no regard for the direction of the deviated well bore axis. Therefore, the tall frac, created by the cylindrical stress field of the sandpacked annulus, injection, line-source in a directionally drilled, deviated well bore provides a unique means for creating and propagating a fracture plane in the geologically most favorable direction along the selected well bore axis. This unique means for controlling the frac direction also applies to a directionally drilled horizontal well.

In FIGS. 20-A and 20-B, the respective areas covered by a long, continuous tall frac are diagrammatically illustrated. The tall frac is shown in FIG. 20-A compared to seven individual conventional fracs created in a multi-zone frac program shown in FIG. 20-B. It should be noted that the long, continuous tall frac will effectively drain every reservoir penetrated by the well bore plus all sand stringers, or permeable zones, penetrated by the well bore which communicate with, and effectively drain, other nearby reservoir bodies not penetrated by the well bore. In contrast, the multi-zone fracs will drain only those few reservoir zones, the seven zones shown FIG. 20-B, selected for these conventional fracs through perforated, cemented casing.

Heretofore, service companies in the oil and gas industry have developed a large multiplicity of "sand-like" granular materials with a variety of special characteristics that are commonly used as an alternative to natural sand for frac propping and for sand packing. The sand packing used, for example, in creating the sandpacked annulus 60 described above. Such alternative, "sand-like" granular material can be selected for use on the basis of desired grain size, shape, density, crushing strength, surface roughness, electrical conductivity, thermal conductivity, mineral content, chemical composition, etc., to provide the desired fluid permeability and other desired physical/chemical properties of the sand-packed annulus 60. Therefore, the terms "sand-propped" and "sandpacked", as used herein, are intended to include any of such granular materials commonly used by the oil and gas industry and sold by hydraulic, frac-pumping service companies as an alternative to natural sand for sand-pack, gravel-pack, sandpacked annulus, or frac-propping applications.

The term "fluidized bed", as used herein, is intended to mean and include any fluid-flow system in which some of the granulated material is suspended in the fluid flow, whether by turbulent flow, laminar flow, or other flow regimes. For example, in vertical or near vertical well bores, the vertical fluid flow up an annulus is directly opposite to the gravity downward fall of the solid granules, thereby providing a means of concentrating the granules to the desired fluidized bed density or granule concentration. This vertical, upward flow, suspending the vertical, downward fall of solid granules, provides the equilibrium solid/fluid balance typically described in most fluidized bed applications.

Alternatively, in horizontal, or nearly horizontal well bores, the fluid flow vector is horizontal, whereas the gravity induced, downward fall of the suspended, solid granules is vertically downward or nearly perpendicular to the flow velocity vector. Consequently, a portion of the granulated particles falls to the bottom portion of the horizontal well bore annulus to build a layer of immobile granules. However, along the top surface of this immobile, granule, fall-out layer, the turbulent fluid flow will carry some of the granulated particles in a turbulent, fluidized bed suspension. When this turbulent, fluidized bed suspension of granulated particles reaches the downstream end of the then existing fall-out layer of granules, the flow velocity will decrease in the larger, fluid flow, cross-sectional area, resulting in the fall-out of a substantial portion of the fluidized bed, turbulent suspended granules, thereby extending the length of the fall-out solid layer of immobile granules.

This progressive, downstream growth of this immobile layer of fall-out granules in a nearly horizontal well bore annulus may be similar to the progressive, downwind growth of a sand dune. Along a surface of a sand done, a strong wind will suspend sand in a turbulent, fluidized bed above the sand done. Then, as the air flow expands and abruptly slows down just downwind from the leading edge of the sand done, the sand will fall downward and accumulate as a downwind extension of the sand done. In like manner, the immobile layer of fall-out granules in near horizontal well bores will progressively grow downstream with the granule fall-out from the abrupt slow-down of the turbulent flow velocity just beyond the leading edge of this immobile fall-out layer. This process can be repeated to build successive layers of immobile, fall-out granules until the well bore annulus is nearly full. Smaller diameter, finer-grained granules may be used to build the top layer of fall-out granules to more fully fill the nearly horizontal well bore annulus.

An alternative means of creating a permeable, fluid passageway along an annulus 45, between a portion of the production casing 31 and the drill hole 20, can be achieved by rupturing and rubblizing the cement emplaced in the annulus. Such annulus cement rupture and rubblizing can be achieved by placing a mechanical vibrator against the production casing 31 to transmit vibration stress through the casing wall and into an annulus cement to cause the rupture, fracturing, and rubblizing of the annulus cement. The annulus cement is not shown in the drawings. The vibration on the annulus cement can be an axial compressive stress, a radial compressive stress, a shear stress, or any other type of stress, which can be effective in the rupturing, fracturing and rubblizing the annulus cement.

Also, the rupturing, fracturing and rubblizing of the annulus cement can be facilitated by using a very low-compressive strength cement or an aerated, porous foam-crete emplaced in the annulus. Such low-compressive strength cement or foam-crete can be ruptured by mechanical vibration of the casing, hydraulic pressure-stretching of the casing, pulling, pushing or reciprocating the casing, rotating the casing, or any other type of casing motion, which can create fracturing stresses in the annulus cement.

Further, the vibration or movements of the casing can be even more effective in rupturing or fracturing the annulus cement when imposed upon fresh, partially set, weak cement before it has matured to its full strength. In such partially set, weak cement or foam-crete, all casing movement by vibration, reciprocation, rotation, etc., can easily rupture, fracture and rubblize the annulus cement to create a suitable, friction-loss, hydraulic flow path for frac-pad fluid flow along the annulus. This friction-loss flow path will provide hydraulic pressure control of subsequent formation fracture growth along the axis of such annulus, friction-loss, hydraulic flow path.

As an additional alternative means of creating a permeable, friction-loss, annulus flow path, a permeable cement may be created by pumping into the annulus a slurry of about 50% to 65% by volume of sand-like granules with about 10% to 20% by volume of an adhesive cementing material which preferentially wets the surface of the granules. The balance of the slurry volume can be an inert liquid which will not wet the surfaces of the sand-like granules. When this slurry fills the desired portion of the annulus, the injection pumping is stopped.

As the slurry stops moving, then the adhesive cementing material, wetting the granular surfaces, will collect around the contact points between the granules, and, upon curing or setting, the granular, surface-wetting, adhesive material will cement together the contact points between the granules to create a substantially immobile, solid assemblage of the granules with high porosity and high permeability. This assemblage of cemented-together granules will constitute a high-permeability, immobile cement to fill the desired portion of the annulus with a friction-loss, hydraulic-fluid flow path to provide the desired annulus-flow pressure gradient to control the progression of hydraulic fracture growth in the rock formation along the annulus.

A further alternative means of creating a friction-loss, annulus, flow-path, permeable cement comprises a slurry of granular material with adhesive bonding fibers disbursed therein being pumped into the annulus. When the desired displacement volume of the slurry has been pumped, then the injection pumping is stopped. As the slurry stops moving, the adhesive bonding fibers will bond to the granular surfaces and to each other to create a network or web of cross-linked fibers and granules adhered to the fibers. This network or web of fibers will hold the granules in a substantially immobile position to create a permeable cement.

If the process of creating the sandpacked annulus by any of these means is interrupted or prematurely terminated, then additional means may be provided to reinitiate and complete the development of such the annulus. The oil and gas industry has developed suitable logging techniques for detecting the intervals covered by the sandpacked annulus and the intervals not covered by the annulus. The production casing just forward or above the sandpacked interval can be perforated.

Then fluid circulation can be reestablished down the well casing, through perforations, and up or forward in the annulus. The sand-packing of the next interval can then proceed by any of the prior-described means.

If the process of propping open the hydraulic fracture by an emplaced, frac sand pack is interrupted or prematurely terminated, then additional means may be provided to reinitiate and complete the packing of the hydraulic fracture by the frac-propping granules. One such additional means to reinitiate the frac-packing operation is to drill an additional length of new, open, drill hole below the prior-hole's total depth. Then, a frac-pad fluid may be used to initiate, in the open hole, a fresh extension of the prior hydraulic fracture. When this fresh extension of the prior hydraulic fracture has propagated to the desired distance along the axis of the well bore's permeable annulus, pumping can start into this frac of a low viscosity fluid with a gel-breaking agent to break the gel of all prior-injected frac fluids and thereby establish the maximum fluid transmissibility through the prior, frac-proppant pack and the permeable annulus.

When this fluid transmissibility is adequate, then a proppant-laden frac fluid can be pumped into and through this new frac extension to create a frac-proppant screen-out in the frac as this low-viscosity frac fluid, depleted of the frac-proppant by this screen-out process, flows through the prior propped fracture and then into and through the permeable annulus to be returned to the surface through the upper annulus. Of course, the frac fluid recovered from the annulus at the surface can be recycled for reuse as frac-pad fluid or frac-proppant fluid.

It should be mentioned that an engineer, skilled in the art of creating, extending, and sand-packing hydraulic fractures, can utilize a multitude of prior, available technologies to reopen, extend, and sand pack a prior, collapsed or terminated hydraulic fracture created by this invention. All such variations being within the true spirit and scope of this invention.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follow:

1. A method for creating a permeable, sandpacked annulus in a bottom of a well bore, the sandpacked annulus used for increasing production of oil, gas and other fluids from a rock formation, the steps comprising:

selecting a granular material of desired grain size, shape, density, crushing strength, surface roughness, electrical conductivity, thermal conductivity, chemical composition to provide a desired fluid permeability in the sandpacked annulus;

pumping the granular material in a frac pad fluid through a production casing to a bottom of the well bore;

forming the permeable, sandpacked annulus in an annulus space between the production casing and the well bore; and creating an unobstructed, open well bore below a bottom of the production casing and below the immobile, permeable, sandpacked annulus subsequent to forming the immobile, permeable, sandpacked annulus between the production casing and the well bore, thereby providing an unobstructed open well bore for initiating a propagation of an hydraulic fracture into the rock formation.

2. A method as described in claim 1 further including the step of introducing unconsolidated sand placed in the unobstructed, open well bore below the bottom of the production casing prior to forming the permeable, sandpacked annulus between the production casing and the well bore and then later, subsequent to creating the immobile, permeable, sandpacked annulus, removing the unconsolidated sand by fluid circulation to reestablish a clean open hole well bore below the bottom of the production casing for initiating and propagating the hydraulic fracture in the rock formation.

3. A method as described in claim 1 further including the step of drilling a new well bore below a bottom of the production casing after forming the permeable, sandpacked annulus between the production casing and the well bore, thereby providing an unobstructed, open well bore for initiation and propagation of an hydraulic fracture into the rock formation.

4. A method as described in claim 3 further including the step of circulating frac fluid with granular, proppant material down the production casing, through the unobstructed, open well bore below the production casing and then out into the hydraulic fracture in the rock formation to create a frac pack of proppant materials in the hydraulic fracture.

5. Method as described in claim 3 further including a step of reopening and extending the hydraulic fracture, which has prematurely collapsed and terminated, and pumping frac proppant granules into a reopened and extended hydraulic fracture.

6. A method as described in claim 5 further including a step of drilling an open hole below the bottom of the production casing and well bore, a depth of the open hole providing an unstressed formation area for initiating an extension of the hydraulic fracture.

7. A method as described in claim 5 further including a step of introducing a low-viscosity frac pad fluid through the permeable annulus and the hydraulic fracture and displacing the prior frac pad fluid found therein and upward through the well bore.

8. A method as described in claim 7 further including a step of introducing a gel-breaking chemical into the low-viscosity frac pad fluid for breaking up all existing gels found in the permeable annulus and hydraulic fracture for ease in recovery of the frac pad fluid from the well bore.

9. A method as described in claim 5 further including a step of adding a granular proppant material in the frac fluid and causing the proppant granules to be screened out in the hydraulic fracture when the frac fluid, without the proppant granules, flows into and through the prior propped portion of the hydraulic fracture and then into and through the permeable annulus and up the well bore.

10. A method for creating a permeable, sandpacked annulus in a well bore using an outer casing disposed between the well bore and a production casing, the sandpacked annulus used for increasing production of oil, gas and other fluids from a selected rock formation interval, the steps comprising:

drilling a well bore and setting the outer casing next to the well bore;

running the production casing downwardly through the outer casing and positioning a bottom of the production casing near a bottom of the well bore:

pumping sand down the production casing and forming a sand fill in the bottom of the well bore;

raising the production casing above the top of the sand fill for creating the sandpacked annulus and setting the bottom of the production casing below the bottom of the outer casing;

selecting a granular material of desired grain size, shape, density, crushing strength, surface roughness, electrical conductivity, thermal conductivity, chemical composition to provide a desired fluid permeability in the sandpacked annulus;

pumping the granular material in a frac pad fluid through the bottom of the production casing and on top of the sand fill;

forming the permeable, sandpacked annulus in an annulus space between the production casing and the well bore and below the bottom of the outer casing; and pumping the frac pad fluid with limited amount of granular material upwardly through an open area annulus between the production casing and the outer casing.

11. The method as described in claim 10 wherein the step of setting the outer casing next to the well bore includes positioning a bottom of the outer casing next to a top of the selected rock formation interval.

12. The method as described in claim 10 wherein the step of setting the bottom of the production casing below the bottom of the outer casing includes positioning the bottom of the production casing next to a bottom of the selected rock formation interval.

13. The method as described in claim 10 wherein the well bore is vertical or near vertical and the frac pad fluid is a fluid with a selected viscosity and gel strength used for circulating the granular material downward through the production casing and upward between the production casing and the well bore.

14. The method as described in claim 11 wherein the sandpacked annulus is incrementally developed as a fluidized sand bed to concentrate solid content in a preferred range from 50% to 65% of granular material, which, upon terminating flow, will collapse forming a nearly continuous sandpacked annulus between the production casing and well bore.

15. The method as described in claim 10 wherein the well bore is horizontal or a highly deviated directionally drilled well bore and the frac pad fluid is a selected fluid with a desired viscosity and gel strength for circulating the granular material through the production casing and creating a fluidized sand bed in an upper portion of an annulus cross-section with the lower portion of the annulus cross-section filled with a layer of semi-solid sandpack created by the granular material fallout from the above fluidized sand bed, the leading edge of the semi-solid sandpack progressively moving downstream in the annulus along the well bore axis by the deposition of fall-out granules from decreased fluid flow velocity in an enlarged fluidized bed, cross-sectional area just downstream from the semi-solid sandpacked layer, with the repetition of the process to create multiple sandpack layers to nearly fill the annulus with the multiple sandpack layers.

16. A method as described in claim 10 further including the step of coating the grains of the granular material with an adhesive-type coating, which, upon curing, will cause the grains of granular material to adhere to each other and form an immobile, permeable, sandpacked annulus.

17. A method as described in claim 14 wherein the immobile, permeable, sandpacked annulus fills a major portion of the annulus space between the production casing and the well bore for preventing the flow or migration of solid particles from an unconsolidated or poorly consolidated formation into the well bore during production of reservoir fluids out of the formation.

* * * * *